US006028563A

United States Patent [19]

Higgins

[11] Patent Number: 6,028,563

[45] Date of Patent: Feb. 22, 2000

[54] DUAL POLARIZED CROSS BOW TIE DIPOLE ANTENNA HAVING INTEGRATED AIRLINE FEED

[75] Inventor: Thomas P. Higgins, Tinton Falls, N.J.

[73] Assignee: Alcatel, Paris, France

[21] Appl. No.: 09/113,045

[22] Filed: Jul. 9, 1998

Related U.S. Application Data

[63] Continuation-in-part of application No. 08/887,877, Jul. 3, 1997, abandoned, and a continuation-in-part of application No. 08/989,437, Dec. 12, 1997, abandoned.

[51] Int. Cl.[7] ..... H01Q 21/26

[52] U.S. Cl. ..... 343/797; 343/810; 343/816; 343/817

[58] Field of Search ..... 343/797, 798, 343/810, 812, 813, 878, 793, 795, 815, 816, 817; H01Q 21/26

[56] References Cited

U.S. PATENT DOCUMENTS

| | | | |
|---|---|---|---|
| 3,541,559 | 11/1970 | Evans | 343/756 |
| 3,740,754 | 6/1973 | Epis | 343/797 |
| 4,184,163 | 1/1980 | Woodward | 343/742 |
| 4,319,249 | 3/1982 | Evans et al. | 343/703 |
| 4,446,465 | 5/1984 | Donovan | 343/797 |
| 4,575,725 | 3/1986 | Theobald et al. | 343/813 |
| 4,983,987 | 1/1991 | Woloszczuk | 343/797 |
| 5,274,391 | 12/1993 | Connolly | 343/820 |
| 5,629,713 | 5/1997 | Mailandt et al. | 343/808 |
| 5,952,983 | 9/1999 | Dearnley | 343/817 |

OTHER PUBLICATIONS

Balanis, Constantine A., "Antenna Theory Analysis and Design", Wiley, 1997, New York, pp. 447–449.

Johnson, Richard C., and Jasik, Henry, Antenna Engineering Handbook, Second Edition, McGraw–Hill Book Company, 1961 pp. 42–4–42–5, 42–8–42–11.

*Primary Examiner*—Hoanganh Le

*Attorney, Agent, or Firm*—Ware, Fressola, Van Der Sluys & Adolphson LLP

[57] ABSTRACT

A dual polarization antenna for transmitting/receiving polarized radio frequency signals includes a reflector plate that reflects the polarized radio frequency signals and one or more dipole assemblies. Each dipole assembly has two cross bow tie dipoles having radiating arms for transmitting/receiving the polarized radio frequency energy signals at two polarizations, and having U-shaped air-filled transmission feedlines for supporting respective radiating arms and providing the radio frequency signals between the reflector plate and the respective radiating arms. Each U-shaped air-filled transmission feedline includes two legs and respective feed rods arranged in respective legs. Each leg has a rectangular shape with three sides for isolating undesirable radio frequency energy. The radiating arms are triangularly-shaped and have notches dimensioned for minimizing radiation pattern distortion due to undesirable radio frequency coupling between the two cross bow tie dipoles. The dual polarization antenna also has an RF isolation device for coupling RF energy back in a proper phase and magnitude to cancel the undesirable RF energy of the respective opposite polarization. The RF isolation device includes an isolation tree or bar, isolation rails, small thin isolation rods or wires arranged in relation to the dipole assembly, or an isolation strip between positive and negative arms of the cross bow tie dipoles; or a combination of one or more of the above.

33 Claims, 19 Drawing Sheets

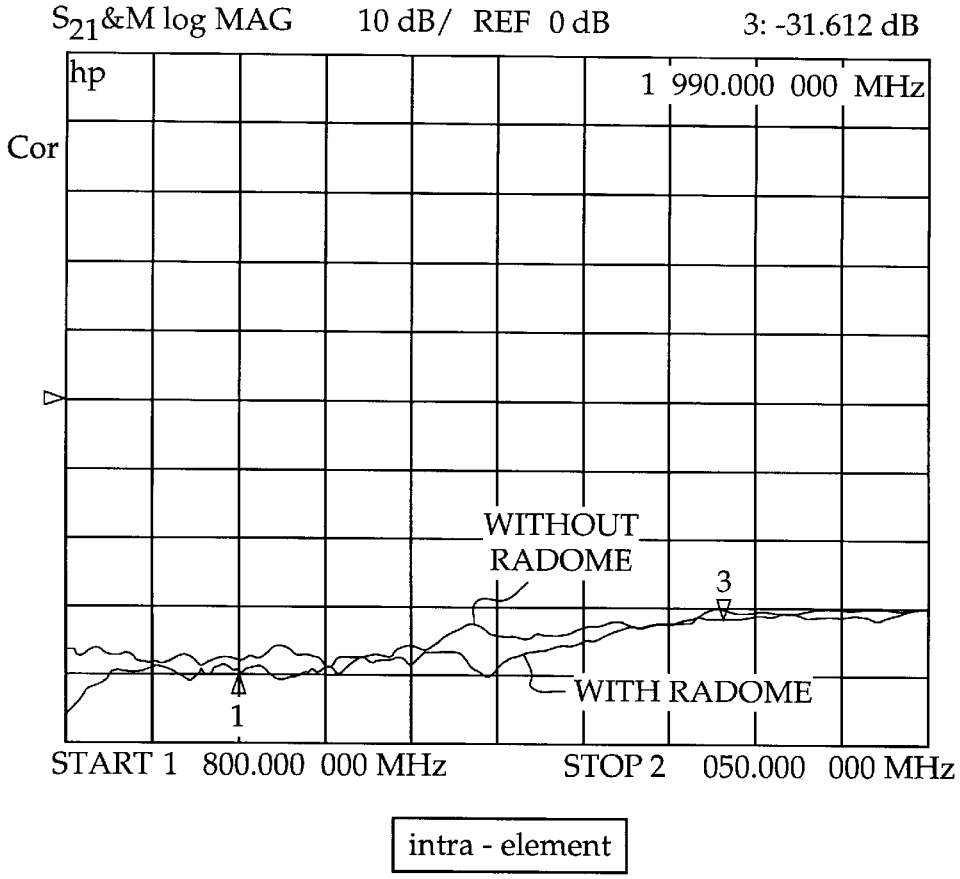
FIG. 11 Isolation of narrow spaced Dipoles with .050 Rod for Feed
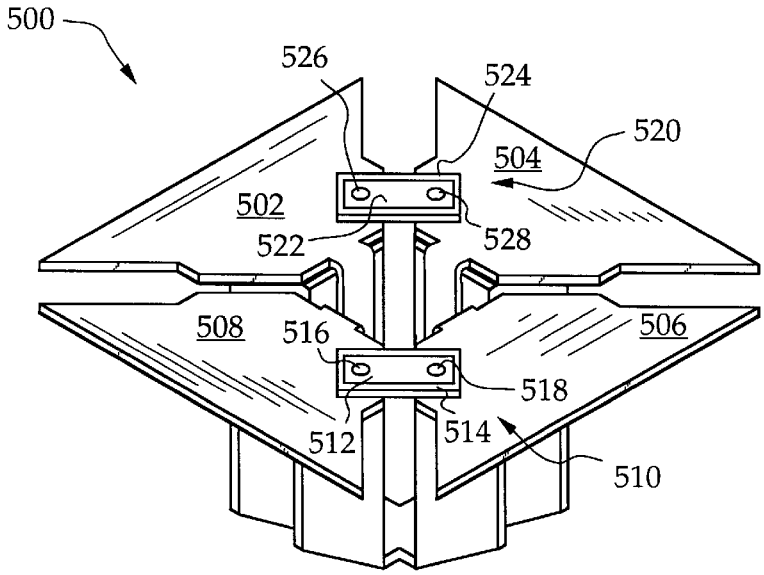
FIG. 29

INPUT MATCH OF
NARROW SPACED BOWTIE DIPOLES
W/ 0.050 ROD FOR FEED

FIG. 17
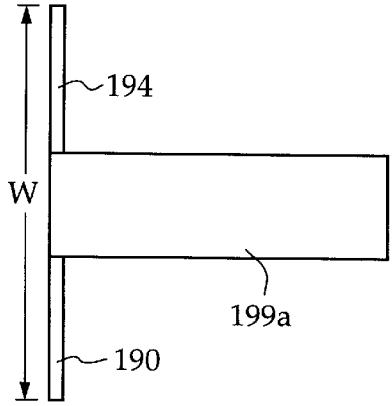
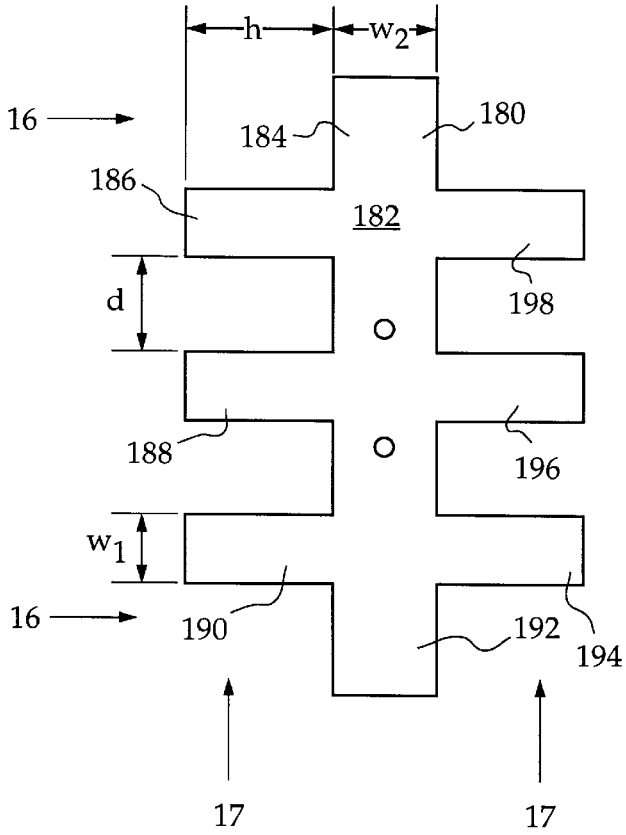
FIG. 15
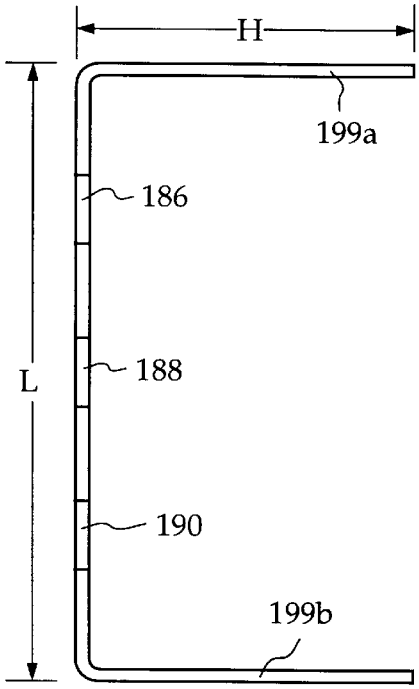
FIG. 16

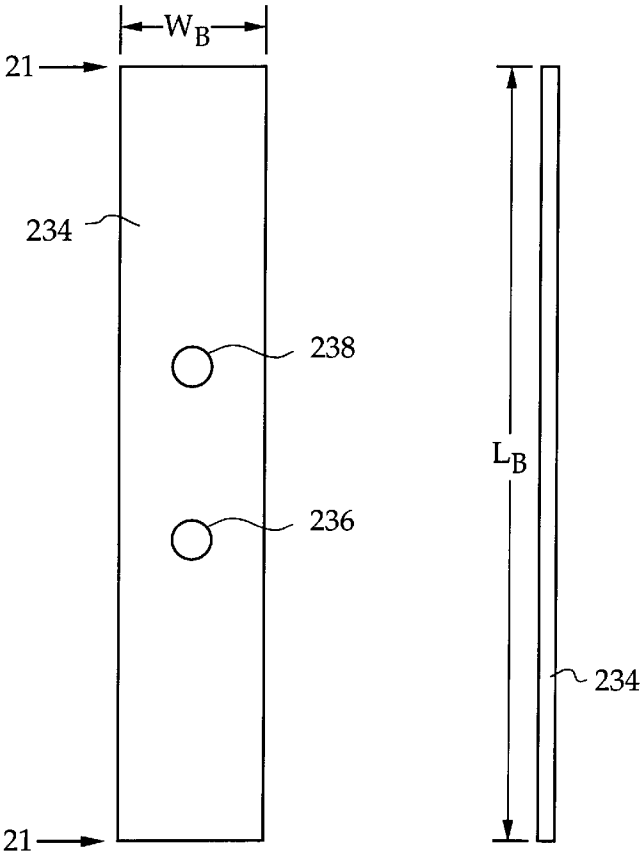
FIG. 20
FIG. 21
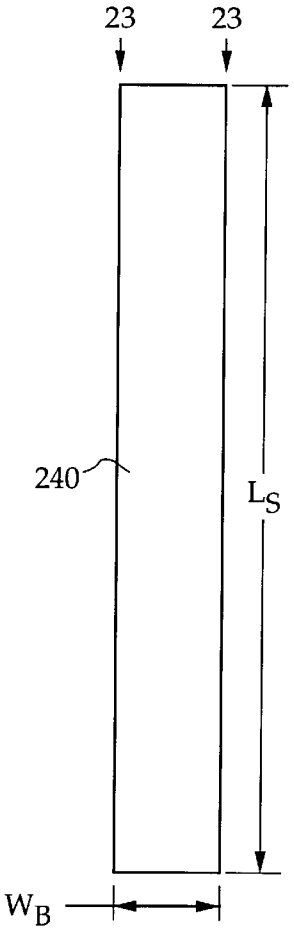
FIG. 22
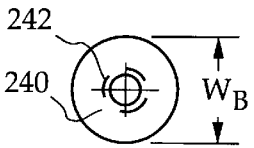
FIG. 23

DUAL POLARIZED CROSS BOW TIE DIPOLE ANTENNA HAVING INTEGRATED AIRLINE FEED

This application is a continuation-in-part of 08/887,877 Jul. 7, 1997, abandoned, which is a continuation-in-part of 08/989,437 Dec. 12, 1997 , abandoned.

BACKGROUND OF THE INVENTION

1. Field of the Invention

The present invention relates generally to antennas; and more particularly, to dual polarized antennas.

2. Description of the Prior Art

In general, dipole antennas have been used for a long time, and many variations have been developed over the years. "Bow tie" dipoles operate like any ordinary half-wavelength dipole, and are described in several textbooks, including Balanis, Constantine A., "Antenna Theory Analysis And Design", Wiley, 1997.

With the increasing popularity of polarization diversity techniques in mobile communications, dual polarized antennas have become more important. These are antennas that radiate two orthogonal polarizations, such as vertical/horizontal (0° & 90°) or +/−45° slant polarizations. Many types of dual polarized antennas have been investigated and are widely available on the open market.

These antennas are divided into two groups:

1. Antennas that utilize single linear polarized elements, but are grouped and fed in such a manner to create a dual polarized array. An example is a patch array (or dipole array), where two separate patches (or two separate dipoles), are required to radiate both polarizations.

2. Antennas that utilize dual polarized elements to make a dual polarized array. Examples are a single patch that radiates two different polarizations, or two crossed dipoles that are constructed in such a manner as to become a single dual polarized element.

Feeding techniques are also a competitive area. Many vendors use coaxial cable, or Teflon dielectric microstrip transmission lines. Antennas that use coaxial cable or Teflon microstrip transmission lines will suffer from reduced efficiency, and possibly generate third-order intermodulation distortion.

Antennas that utilize single linear polarized elements need to have them carefully placed on the ground plane (reflector) in order to radiate symmetrical patterns. Also, good port-to-port isolation (between the two inputs) can be very difficult to achieve on an antenna that has a reflector crowded with many elements. When using air dielectric transmission lines, the process of feeding the radiators can also become very unwieldy with so many varying locations for signals to be fed.

Dual polarized antennas that utilize dual polarized elements suffer from other problems. Crossed dipole elements need to be extra-long to provide good intra-element (within the same dual-polarization element isolation), this leads to a dipole impedance which is so high (200 ohms) as to make it difficult to match over a broad bandwidth. Even without an extra-long element, the dipole impedance is high (150 ohms).

A single dual polarized patch antenna has poor port-to-port isolation, bandwidth, and cross-polarization discrimination characteristics; while many of these problems can be minimized with various techniques, the trade-off analysis is a delicate process.

Propagating radio waves are weakened and distorted by the environment in which they travel. In addition, when two waves arrive at the same point with an opposite phase and equal amplitude, they cancel one another out, resulting in a phenomenon known as multipath fading. Many cellular phone connections are typically lost due to multipath fading. One solution known in the art to this problem is a spatial diversity technique, wherein two different antennas are used and separated, for example, by about 20 wavelengths, for receiving (or transmitting) the same information on two separate radio signal paths. However, one problem with such an approach is that two antennas are needed to receive (or send) one signal, while communities are trying to minimize the number of antennas.

In view of the above, there is a real need in the prior art for an antenna that solves the multipath fading problem, that reduces the number of antennas, that solves the coaxial cable dielectric signal loss problem, that eliminates unnecessary solder joints, screw connections and pressure connections, and that is easily manufactured.

Moreover, a very important aspect of a dual polarization antenna is isolation between the two different inputs that correspond to the two different polarizations. Isolation in this case is defined as a ratio of power leaving one port to the power entering the other port. Ideally the ratio of power will equal 0.0 in terms of linear magnitude or $-\infty$ dB (decibels), which means that all power entering a port will be radiated by the antenna, or reflected back through the same port, which is represented by a non-ideal voltage standing wave ratio (VSWR). But realistically a ratio of 1/1000 to 1/100 (or −30 to −20 dB) is an attainable goal for isolation. A good isolation characteristic is important to a user, especially when used in a configuration where the antenna is used for transmission and for reception. This is because some of the transmitted power, if the isolation characteristic is bad, will leak back into the other port and overwhelm the receiver attached thereto.

Degradation in isolation can arise from several sources such as: (1) Leakage in radio frequency (RF) energy from the feed system of one polarization to the feed system of the opposite polarization; (2) Intra-element coupling, arising from RF energy "leaked" within a single dual-polarized element, from one dipole to its opposite polarized dipole, which then makes its way back to the opposite input port; and (3) Inter-element coupling that arises from RF energy which couples from one polarization to the opposite polarization, but only between adjacent (dual-polarized) elements, which then makes its way back to the opposite input port.

Techniques used in the past vary for non-bow tie cross dipole antennas, including careful arrangement of radiating elements on the reflector, careful selection of dipole length, the addition of such things as additional walls (or "fences") between radiating elements, or additional walls lengthwise in the array plane.

But these approaches and the cross dipole antennas resulting therefrom have some shortcomings. Careful arrangement of radiating elements on the reflector cannot be done in the case of dual polarized cross bow tie dipoles because this technique needs separate radiating elements, which can be moved relative to each other. Walls or fences between radiating elements may have a result of contributing to a cross polarization component in the far field radiation pattern. Walls or fences lengthwise in the array plane have a result of narrowing the azimuth beamwidth, and also contribute to a cross polarization component in the radiation pattern. These techniques have worked with plain cross dipoles in the past, however, they have not been shown to be effective with dual polarized antennas having cross bow tie dipoles.

The above mentioned devices do not contribute significantly toward improving isolation for cross bow tie dipole antennas. In view of the above, there is a real need in the art for an antenna that solves these problems.

SUMMARY OF THE INVENTION

The present invention provides a new and useful dual polarized antenna for transmitting or receiving radio frequency signals at two different polarizations that includes a reflector plate and one or more dipole assemblies. The reflector plate is a ground plane and reflects the polarized radio frequency signals. The one or more dipole assemblies have two cross bow tie dipoles with radiating arms for transmitting or receiving the polarized radio frequency signals at two polarizations. The two cross bow tie dipoles also have U-shaped air-filled transmission feedlines or rods for supporting respective radiating arms and for providing the polarized radio frequency signals between the reflector plate and the respective radiating arms.

Each U-shaped air-filled transmission feedline means includes two legs and a respective feed rod arranged in a respective one of the two legs. Each leg has a rectangular shape with at least three sides for isolating undesirable radio frequency energy. The respective radiating arms include triangularly-shaped arms, each having notches dimensioned for minimizing radiation pattern distortion due to undesirable radio frequency coupling between the two cross bow tie dipoles. Each U-shaped air-filled transmission feedline may also be shaped as an oval or circle to achieve substantially the same isolating function, although the invention is not intended to be limited to any particular shape of the dipoles, because embodiments are envisioned in which the dipoles are shaped as a rectangle, a clover-leaf, or a semi-circle.

In a preferred embodiment, each leg of the U-shaped air-filled transmission feedline and triangularly-shaped arm is stamped and bent from metal.

One important advantage of the present invention is that it substantially reduces the undesirable effect of multipath fading, because if one polarization signal is fading, then the other polarization signal is substantially not fading.

Other important advantages of the antenna of the present invention are that the antenna eliminates the undesirable signal losses when coaxial cable is used, the antenna minimizes the number of solder joints, thus minimizing the need for screws and other pressure connections, that the antenna is easily manufactured, that the antenna is made from similar metals such as aluminum, thus eliminating signal losses due to couplings between dissimilar metals, and that the antenna eliminates the harmful effect from moisture build-up since the three sided U-shaped channel allows moisture to run-off.

Moreover, the present invention also provides one or more isolation devices for the aforementioned dual polarization antenna for coupling undesired RF energy having a phase and magnitude so as to cancel the undesired RF energy coupled between dipoles of opposite polarization. The one or more isolation devices may include (1) one or more isolation trees or bars in relation to bow tie assemblies; (2) one or more isolation rails arranged alongside bow tie assemblies; (3) one or more small thin isolation rods or wires arranged in or on a radome that covers bow tie assemblies; (4) one or more isolation strips coupled between a positive and negative arm of bow tie assemblies; or (5) a combination of one or more of the above.

One important advantage of this RF isolation technique is that it minimizes undesired RF from coupling between dipoles of opposite polarization, and contributes toward the overall improvement in the antenna performance.

Other objects of the invention will in part be obvious and will in part appear hereinafter.

Accordingly, the invention comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the nature of the invention, reference should be made to the following detailed descriptions taken in connection with the accompanying drawing, not drawn to scale, in which:

FIG. 11 is a graph of the isolation with and without a radome of narrow spaced dipoles for a feed rod having a diameter of 0.050.

FIG. 15 is an elevational view of an isolation tree similar to that shown in FIG. 13.

FIG. 16 is a side view of the isolation tree shown in FIG. 15 along lines 16—16.

FIG. 17 is another side view of the isolation tree shown in FIG. 15 along lines 17—17.

FIG. 20 is an elevational view of an isolation bar shown in FIG. 19.

FIG. 21 is a side view of the isolation bar shown in FIG. 20 along lines 21—21.

FIG. 22 is a side view of a standoff of the isolation bar shown in FIG. 19.

FIG. 23 is a cross-section of the standoff shown in FIG. 11 along lines 23—23.

FIG. 29 is a perspective view of an embodiment of an antenna also having an RF isolation device.

BEST MODE FOR CARRYING OUT THE INVENTION

The Dual Polarization Antenna 20

Figure 1:
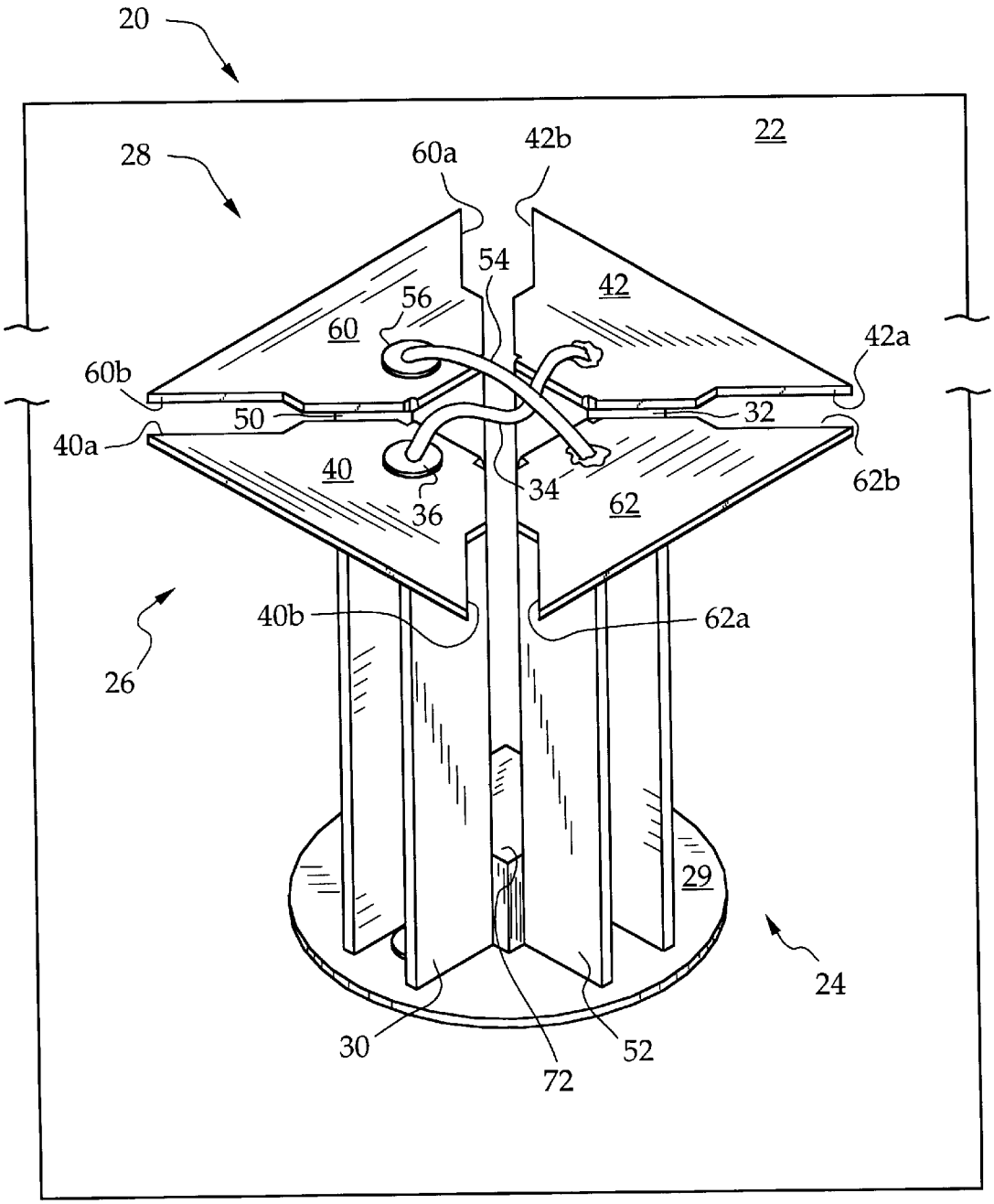
FIG. 1 is a perspective view of a cross bow tie antenna.

FIG. 1 shows a dual polarization antenna generally indicated as 20 herein for transmitting or receiving polarized radio signals. The dual polarization antenna 20 includes a reflector plate 22 and one or more bow tie assemblies generally indicated as 24 arranged thereon (only one of which is shown in FIG. 1). The reflector plate 22 is a ground plane and reflects RF energy. A typical antenna may include twelve bow tie assemblies 24 arranged in a 1×12 array, as shown and described below. The scope of the invention is not intended to be limited to the number of bow tie assemblies 24 in a particular antenna.

Each bow tie assembly 24 includes first and second cross bow tie dipoles generally indicated as 26, 28 mounted on a conductive base 29 and positioned with respect to the reflector plate 22 so as to have respective orthogonal polarizations of +45 degrees and −45 degrees that transmit or receive the RF energy at two polarizations.

The first cross bow tie dipole 26 is formed by legs 30, 32; a feed rod 34; upper and lower insulating grommets 36, 38 (FIGS. 2 and 3); a triangularly-shaped negative arm 40; and a triangularly-shaped positive arm 42. As best shown in FIG. 1, the triangularly-shaped negative arm 40 is arranged on the leg 30, and the triangularly-shaped positive arm 42 is arranged on the leg 32. The leg 30 and the feed rod 34 together form a U-shaped air-filled transmission feedline, and an upper end of the feed rod 34 is connected to the triangularly-shaped positive arm 42 by solder or the like.

The second cross bow tie dipole 28 is formed by legs 50, 52; a feed rod 54; upper and lower insulating grommets 56, 58 (FIG. 3); a triangularly-shaped negative arm 60; and a triangularly-shaped positive arm 62. The triangularly-shaped negative arm 60 is arranged on the leg 50, and the triangularly-shaped positive arm 62 is arranged on the leg 52. The leg 50 and the feed rod 54 together also form a U-shaped air-filled transmission feedline, and an upper end of the feed rod 54 is connected to the triangularly-shaped positive arm 62 by solder or the like.

Each feed rod 34, 54 is passed through a respective insulating grommet 36, 56 of a respective negative arm 40, 60 and connected by solder to a respective positive arm 42, 62. The diameter of the feed rod 34, 54, after protruding through an opening 76 (FIG. 4), discussed below, also has an impact on isolation between the two dipoles 26, 28. Smaller diameter rods have a higher isolation. The isolation between the two dipoles is 30–35 dB.

As shown, the legs 30, 32, 50, 52 are U-shaped and air-filled; however, the scope of the invention is not intended to be to any particular type or shape of the legs 30, 32, 50, 52. For example, embodiments are envisioned using features of the present invention set forth herein that may include one or more of the legs 30, 32, 50, 52 being coaxial cables.

The triangularly-shaped negative arm 40 includes notches 40*a*, 40*b*; the triangularly-shaped positive arm 42 includes notches 42*a*, 42*b*; the triangularly-shaped negative arm 60 includes notches 60*a*, 60*b*; and the triangularly-shaped positive arm 62 includes notches 62*a*, 62*b*. The respective notches 40*a*, 40*b*; 42*a*, 42*b*; 60*a*, 60*b* and 62*a*, 62*b* are dimensioned for minimizing radiation pattern distortion due to undesirable RF coupling between the dipoles 26, 28 forming the dipole assembly 24. Moreover, as the gap between adjacent arms 40, 60; 40, 62; 42, 60 and 42, 62 is reduced, the impedance of the antenna is decreased, and vice versa. Minimal impedance is desired to maximize the bandwidth of the antenna 20. However, when the gap between adjacent arms is lessened, RF distortion also increases due to undesirable coupling between the dipoles. The notches 40*a*, 40*b*; 42*a*, 42*b*; 60*a*, 60*b* and 62*a*, 62*b* thus strike a unique balance by allowing a decrease in the impedance of the antenna and a decrease in the undesirable distortion, while providing desirable radiation patterns. In one embodiment, the gap between the notches 38*a*, 44*b*; 38*b*, 40*a*; 40*b*, 42*a* and 42*b*, 44*a* is dimensioned to be 2½ times the gap between the unnotched portion of the adjacent arms 34*a*, 36*a*; 34*a*, 36*b*; 34*b*, 36*a* and 34*b*, 36*b*. The scope of the invention is not intended to be limited to any particular dimension of the notches. Moreover, the scope of the invention is not intended to be limited to any particular shape of the dipole.

The first and second cross bow tie dipoles 26, 28 can be smaller than ½λ in length. In one embodiment, the length of the bow tie dipoles 26, 28 was 0.44λ, which leads to a lower impedance element. The cross bow tie dipoles 26, 28 have inherently low impedance, but when made as short as possible, they have an even lower impedance element. Also, the short bow tie elements do not suffer from reduced intra-element isolation, as do standard crossed dipoles. The two cross bow tie dipoles 26, 28 also have inherently high cross-polarization discrimination. The two cross bow tie dipoles 26, 28 are mounted on the reflector plate 22 to have the respective orthogonal polarizations of +45 degrees and −45 degrees.

Figure 2:
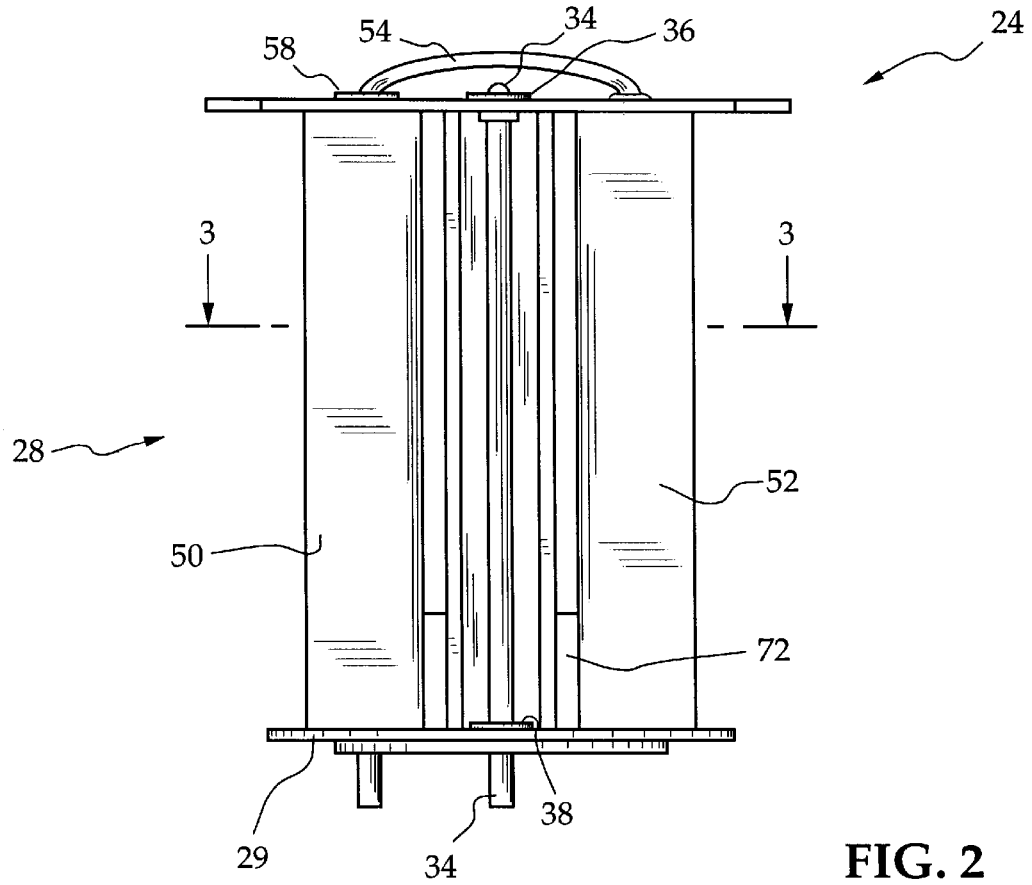
FIG. 2 is a side view of the antenna shown in FIG. 1.
Figure 3:
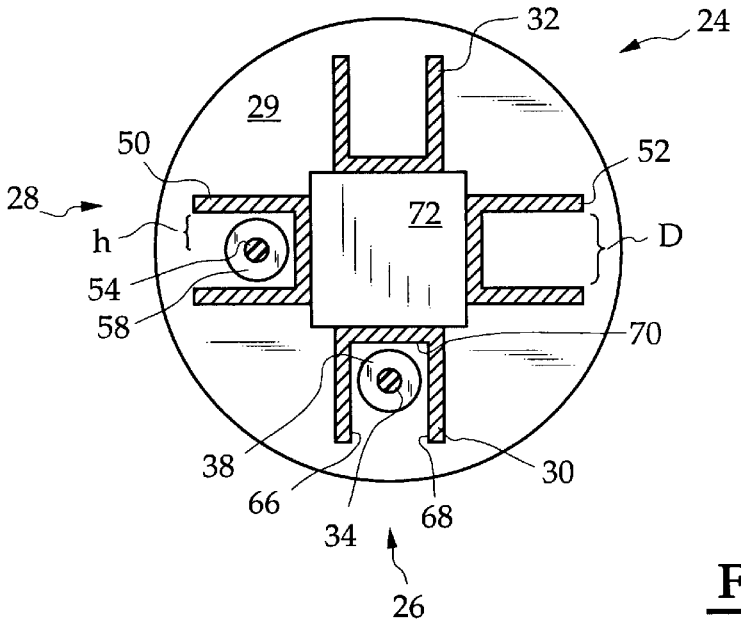
FIG. 3 is a cross-sectional view of the antenna shown in FIG. 2 along lines 3—3.

As best shown in FIGS. 2 and 3, in the first bow tie dipole 26, the leg 30 has two side walls 66, 68 and a back wall 70. The feed rod 34 shown in FIG. 3 passes within the channel formed by the two sidewalls 66, 68 and the back wall 70 in a manner that does not make contact with any of the walls 66, 68, 70 for isolating undesirable radio frequency energy from coupling to the opposite port, and also for minimizing "leaky-wave" radiation from influencing the antenna radiation pattern. The leg 32 is similarly constructed. The legs 30, 32, 50, 52 eliminate the need for coaxial cables, and allow a design having all similar metals such as aluminum, which substantially decrease undesirable intermodulation distortion. One problem in the art has been that the use of dissimilar metals results in undesirable intermodulation distortion in the antenna signal. The use of coaxial cables also results in undesirable signal losses. The feed rod 34 passes through the upper and lower insulating grommets 36, 38, which insulate the feed rod from the conductive base 29 to which the leg 30 is attached. The lower end of the feed rod 34 extends below the conductive base 29 for connection to transmission and/or reception equipment shown in FIGS. 8A and 8B.

The second dipole 28 is similarly constructed. As shown, the feed rods 34 and 54 do not touch each other. It has been experimentally found that the diameter of each feed rod 34, 54 has an effect on isolation of the adjacent dipole. Smaller diameter feed rods result in greater isolation between adjacent dipoles of the same bow tie assembly in a range of 30–35 dB. As shown, the conductive base 29 has a ¼λ dipole spacer shorting plate 72 connected to the four legs 30, 32, 50, 52.

Different RF signals may be applied to feed rods 34, 54 for transmitting or receiving radio signals at two different polarizations. In the embodiment shown and described, the polarized radio frequency signals have orthogonal polarizations, although the scope of the invention is not intended to be limited to only such orthogonal polarizations.

Figure 4:
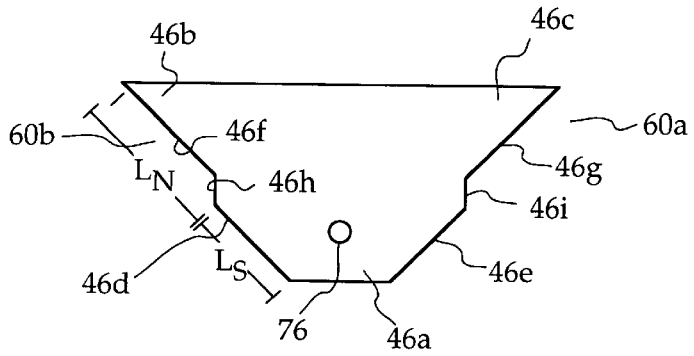
FIG. 4 is a diagram of a typical triangularly-shaped negative arm of the antenna shown in FIG. 1.

FIG. 4 shows the triangularly-shaped negative arm 60, having an inner corner 46*a* with an angle of 90 degrees, two outer corners 46*b*, 46*c* with angles of 45 degrees, and sides generally indicated as 46*d*, 46*e*, in relation to the inner corner portion 46*a* and outer corners 46*b*, 46*c*. Each outer corner 46*b*, 46*c* has a symmetrical notch 60*a*, 60*b* (see FIG. 1) cut therein along the side 46*d*, 46*e*. Each symmetrical notches 60*a*, 60*b* has a first edge 46*f*, 46*g* substantially parallel to the respective side 46*d*, 46*e* and has a second edge 46*h*, 46*i* disposed at about a 45 degree angle (may also be described as 135 degrees) in relation to the side 46*d*, 46*e*. The inner corner 46*a* has an opening 76 for receiving the insulating grommet 56 (FIG. 1) arranged therein. The opening 76 provides a shunt capacitance to match the impedance of the dipole 26, 28 to the legs 30, 32. When the bow tie dipole is made small, there is an inductive component to the impedance that is then tuned out by the diameter of the opening 76 and the corresponding opening (not shown). The scope of the invention is not intended to be limited to any particular size or shape of the opening 76.

Each side 46*d*, 46*e* has a length generally indicated as Ls and each symmetrical notch 60*a*, 60*b* has a corresponding length generally indicated as Ln that is substantially equal to the length of the respective side. The ratio of the length Ls of the respective side to the corresponding length Ln of each symmetrical notch 60*a*, 60*b* is in a range of about 1:3 to 3:1. The scope of the invention is not intended to be limited to a triangle shape that has the aforementioned defined inner and corner angles. For example, an embodiment is envisioned in which a triangle shape is used having three corners having a 60 degrees angle. In such embodiments the notches may be eliminated. The angle of the inner corner may range from 0 degrees (i.e. a straight dipole) to the embodiment shown having an inner corner having a 90 degree angle. The triangularly-shaped arms 40, 42, 62 are similarly constructed.

The dual polarization antenna 20 further comprises a base 62 for mounting on the reflector plate 22 (FIG. 1). A person skilled in the art would appreciate how one or more antennas are mounted on a typical reflector plate. The base 62 has a ¼λ dipole spacer 72 shorting plate connected to the legs 30, 50, 32, 52. As shown, the base 62 has a bottom opening (not shown) for receiving the insulating grommets 38, 58. Each bottom opening (not shown) provides a shunt capacitance to match the impedance between the respective leg 30, 50 to the respective feed rod 34, 54. Each insulating grommet 36, 38, 56, 58 may be made of Teflon, or other suitable insulating material. The scope of the invention is not intended to be limited to any particular size or shape of the bottom opening (not shown), or the type of material used for the insulating grommet 36, 38, 56, 58.

The radio signals may include a first radio signal and a second radio signal that is independent of the first radio signal, for transmitting or receiving radio signals at two different polarizations. In the embodiment shown and described, the polarized radio signals have orthogonal polarizations, although the scope of the invention is not intended to be limited to only such orthogonal polarizations. Alternatively, the radio signals may also include a first radio signal and a second radio signal having a 90 degree phase difference from the first radio signal, for transmitting or receiving circularly polarized radio signals, which may also have orthogonal polarizations.

The characteristic impedance of each U-shaped rectangular air-filled transmission feedline 30, 32, 34, 50, 52, 54 is substantially the same as the impedance of a respective cross bow tie dipole 24*a*, 24*b*, and is calculated by the following equation:

$$Z_0 = \frac{138}{\sqrt{\varepsilon_r}} \operatorname{Log}_{10}\left[\frac{4D}{\pi d}\operatorname{Tanh}\frac{\pi h}{d}\right]$$

where D is a one-sided or open dimension of the leg 30, 32, 50, 52, d is a diameter of a respective feed rod 34, 54, and h is a distance from a respective single wall of the leg 30, 32, 50, 52 to a respective center of the respective feed rod 34, 54.

In operation, the dual polarized bow tie antenna of the present invention exhibits excellent intra-element, port-to-port isolation (>30 Db), and more importantly, significantly lower impedance (approximately 60–70 ohms), which leads to a higher bandwidth. The dual polarized bow tie element also exhibits excellent cross polarization discrimination. The airline feed allows a feed line made of the same material as the rest of the element, so that welding or soldering can be used to decrease third order intermodulation distortion.

One important advantage of using polarization diversity reception and/or transmission is the mitigation of the undesirable effects of multipath fading in wireless communication links.

Figure 5:
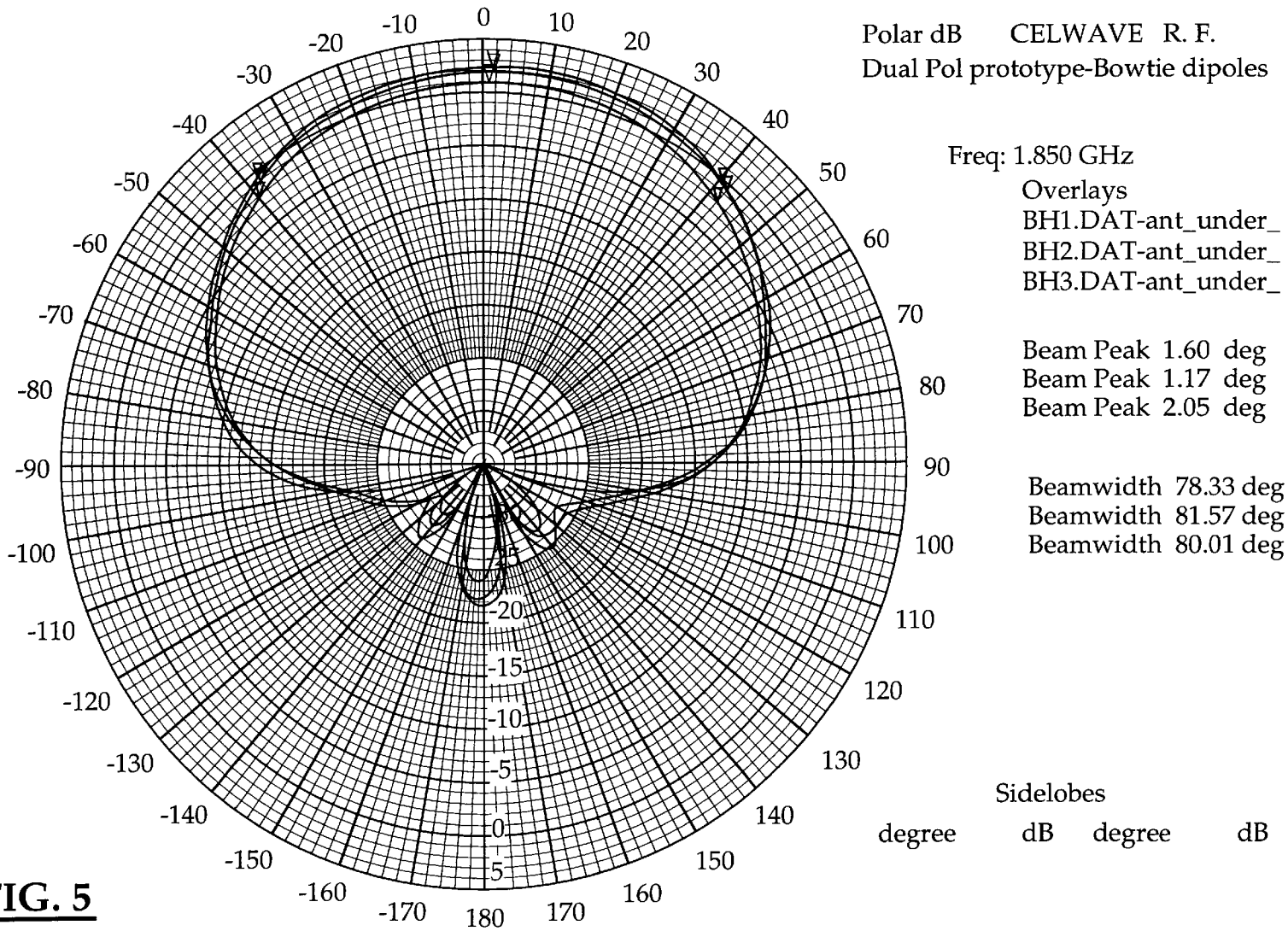
FIG. 5 is a plot of three radiation patterns having beamwidths of 78.33 degrees at 1.85 Gigahertz, 81.57 degrees at 1.92 Gigahertz and 80.01 degrees at 1.99 Gigahertz respectively for a 1×12 arrayed antenna using the subject matter of the invention shown in FIG. 1.
Figure 6:
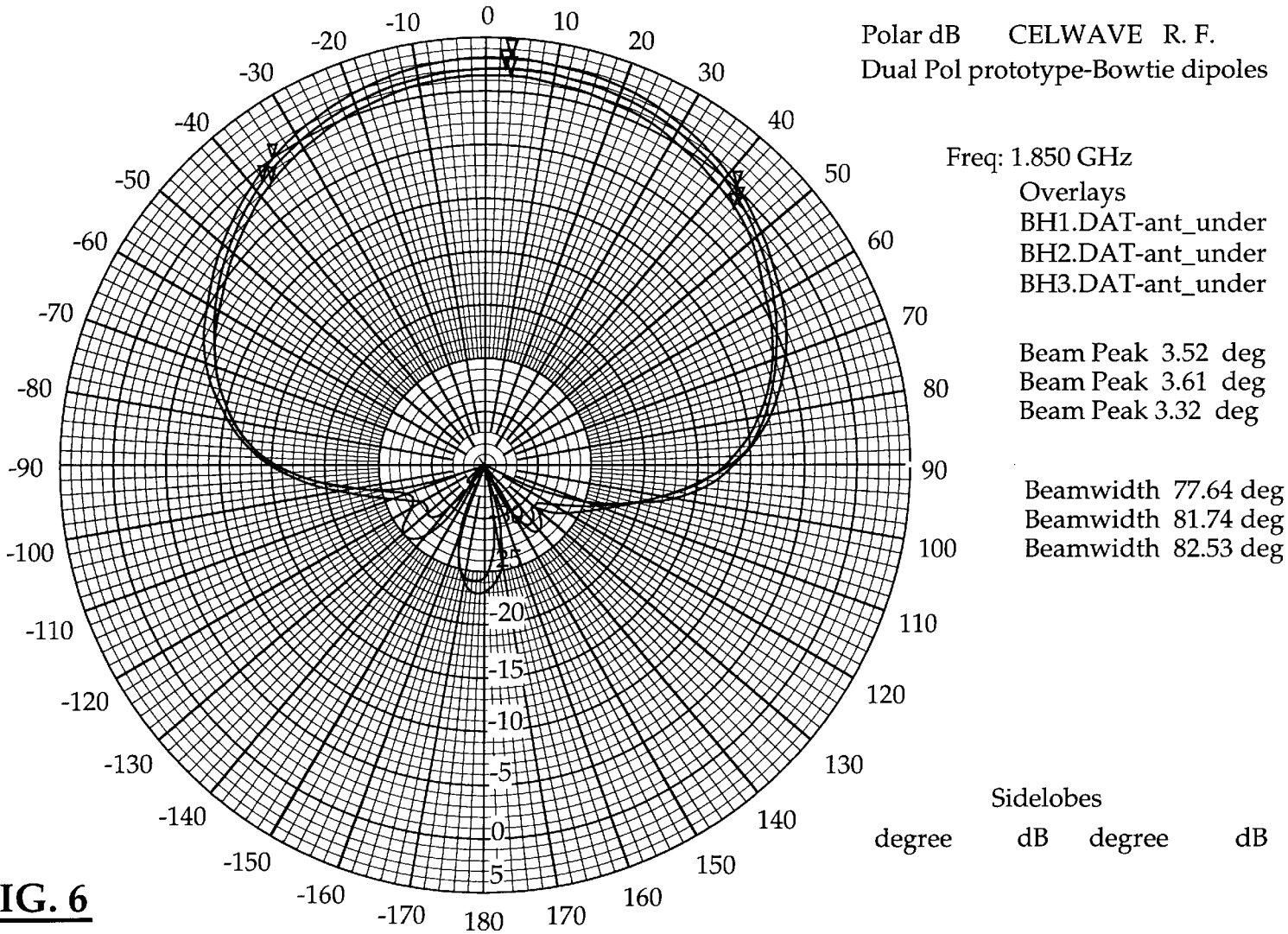
FIG. 6 is a plot of three radiation patterns having beamwidths of 77.64 degrees at 1.85 Gigahertz, 81.74 degrees at 1.92 Gigahertz and 82.53 degrees at 1.99 Gigahertz respectively for a 1×12 antenna using the subject matter of the invention shown in FIG. 1.

FIGS. 5 and 6 show a plot of radiation patterns for the typical 1×12 antenna.

Figure 7:
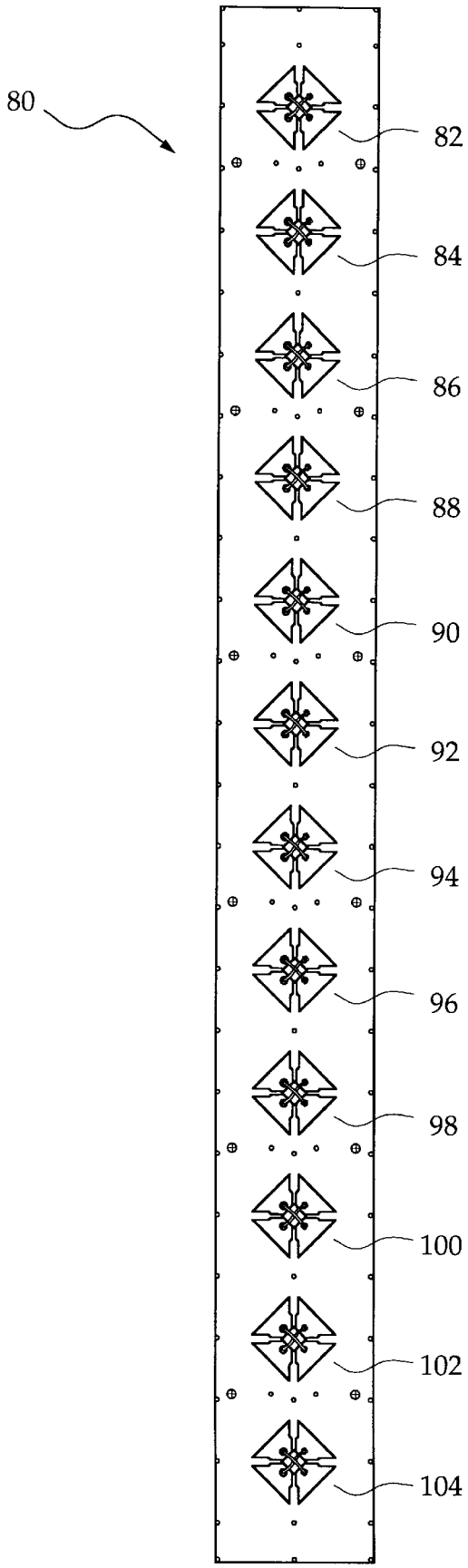
FIG. 7 shows an embodiment for an antenna having a 1×12 array using the subject matter of the invention shown generally in FIG. 1.

FIG. 7 shows an embodiment for an antenna generally indicated as 80 having a 1×12 array of cross dipoles using the subject matter of the invention shown generally in FIG. 1. The 1×12 array includes a reflector plate 81, twelve cross bow tie dipole and feedline assemblies generally indicated as 82, 84, 86, 88, 90, 92, 94, 96, 98, 100, 102, 104, each having two cross bow tie dipoles 24 described above.

Figure 8A:
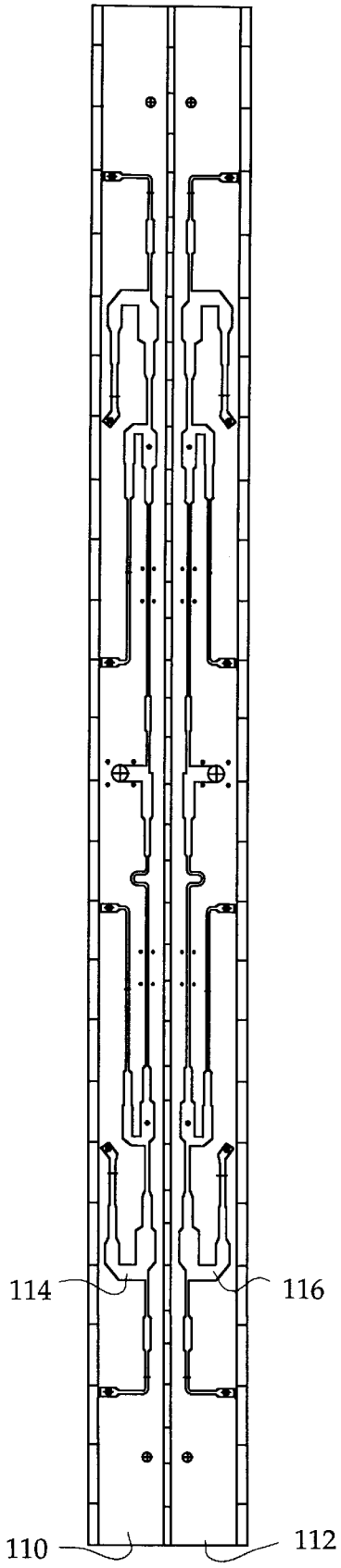
FIGS. 8A and 8B show a feed system for the 1×12 array in FIG. 7.
Figure 8B:
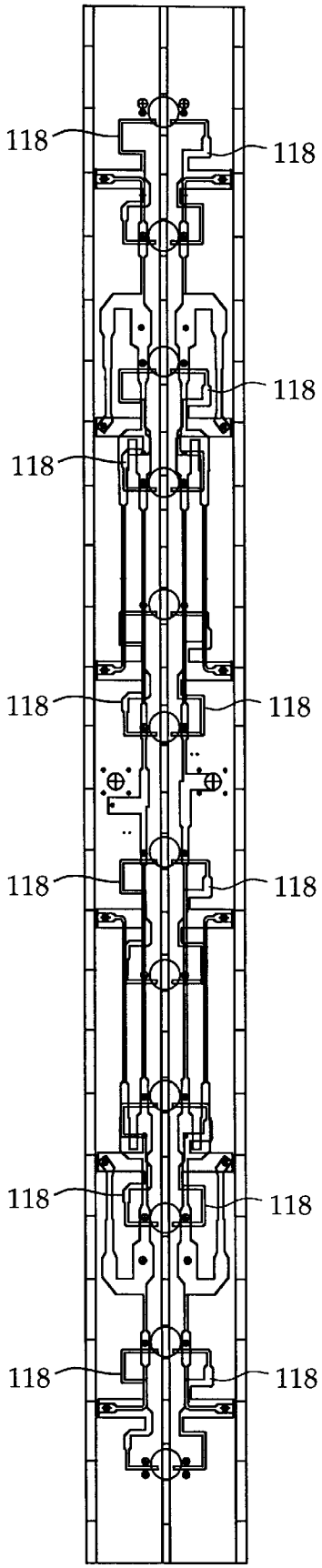
Figure 9:
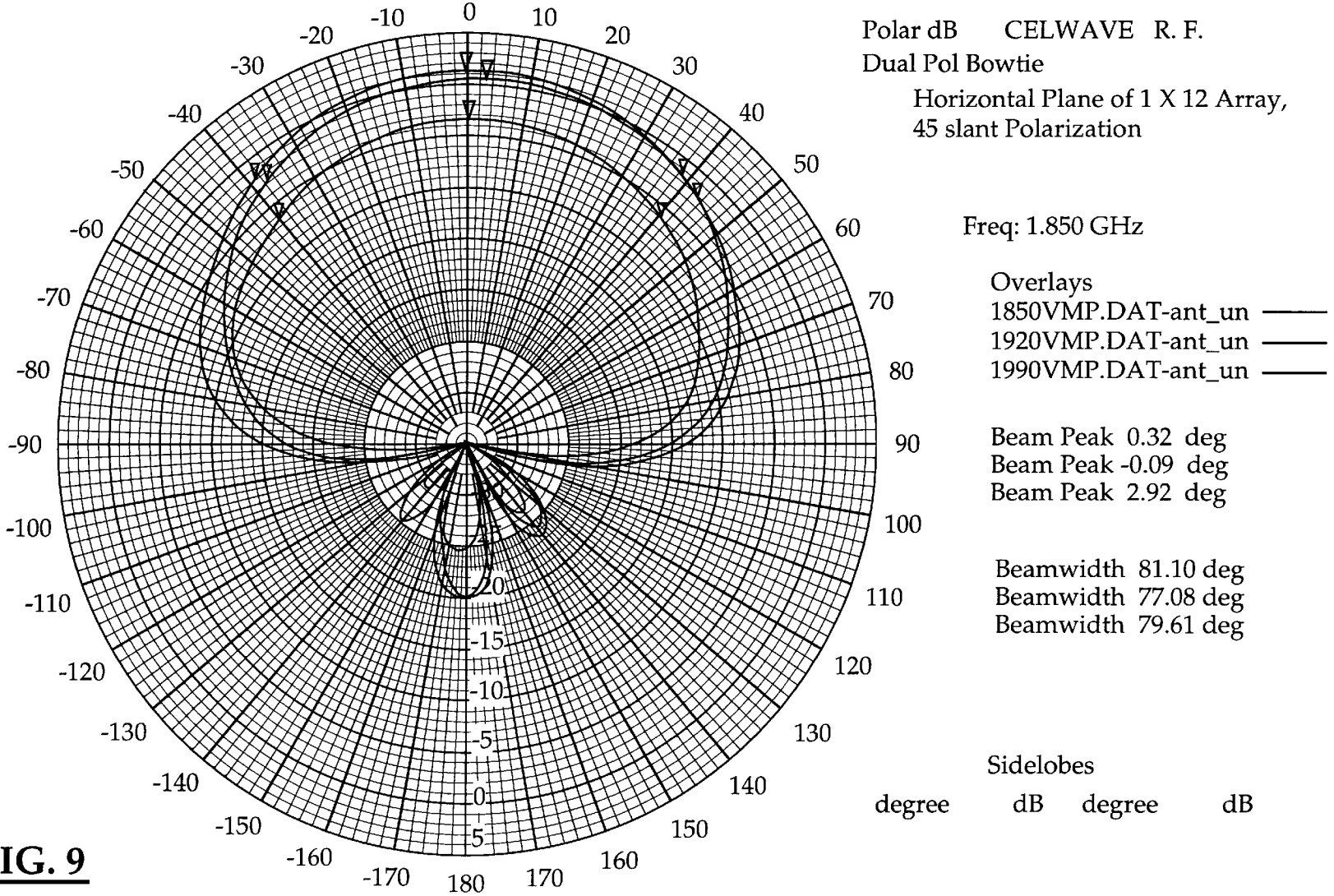
FIG. 9 is a plot of three radiation patterns having beamwidths of 81.10 degrees at 1.85 Gigahertz, 77.08 degrees at 1.92 Gigahertz and 79.61 degrees at 1.99 Gigahertz respectively for a 1×12 arrayed antenna using the subject matter of the invention shown in FIG. 1.
Figure 10:
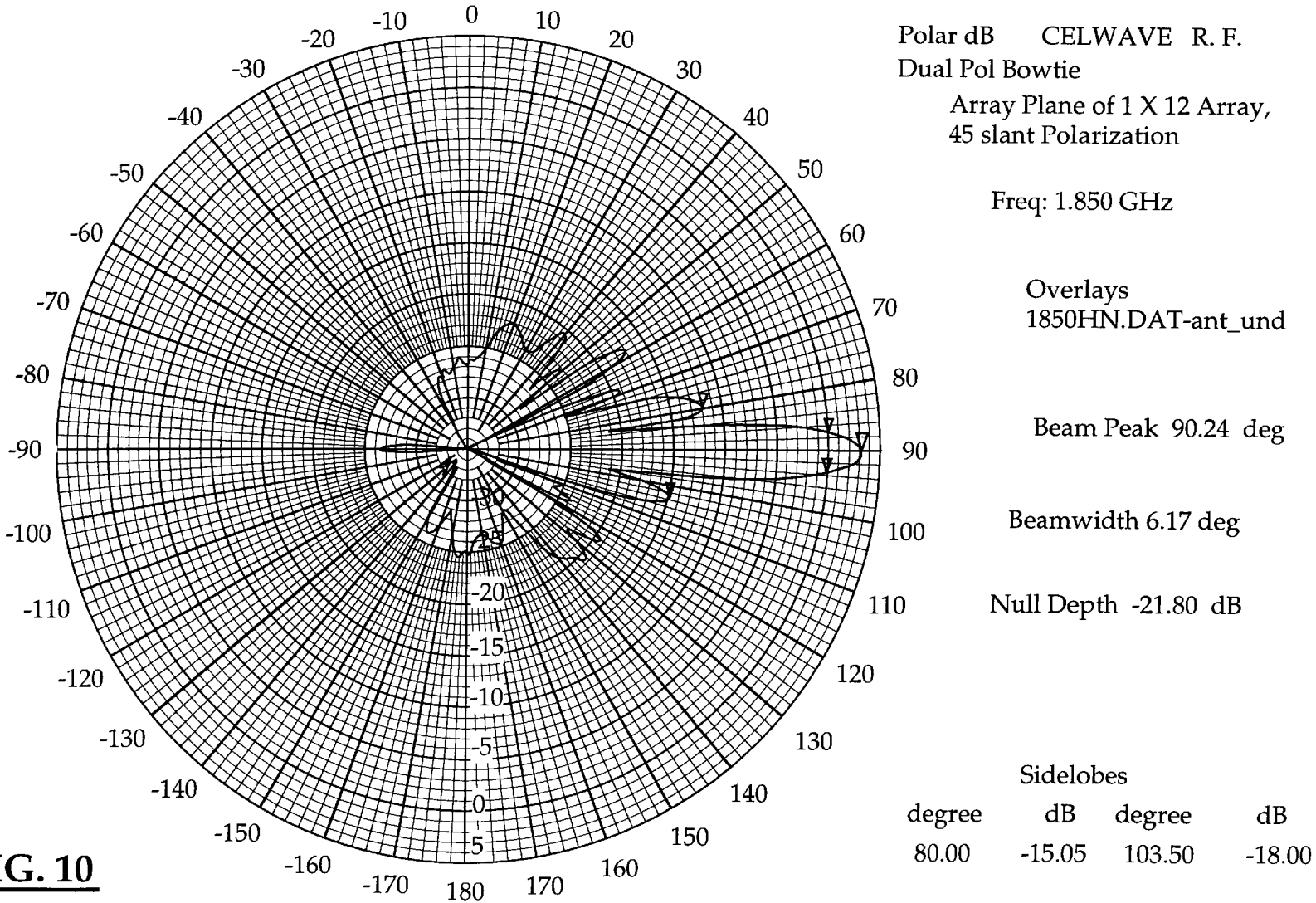
FIG. 10 is a plot of a radiation pattern having beamwidths of 6.17 degrees respectively for a 1×12 antenna using the subject matter of the invention shown in FIG. 1.
Figure 12:
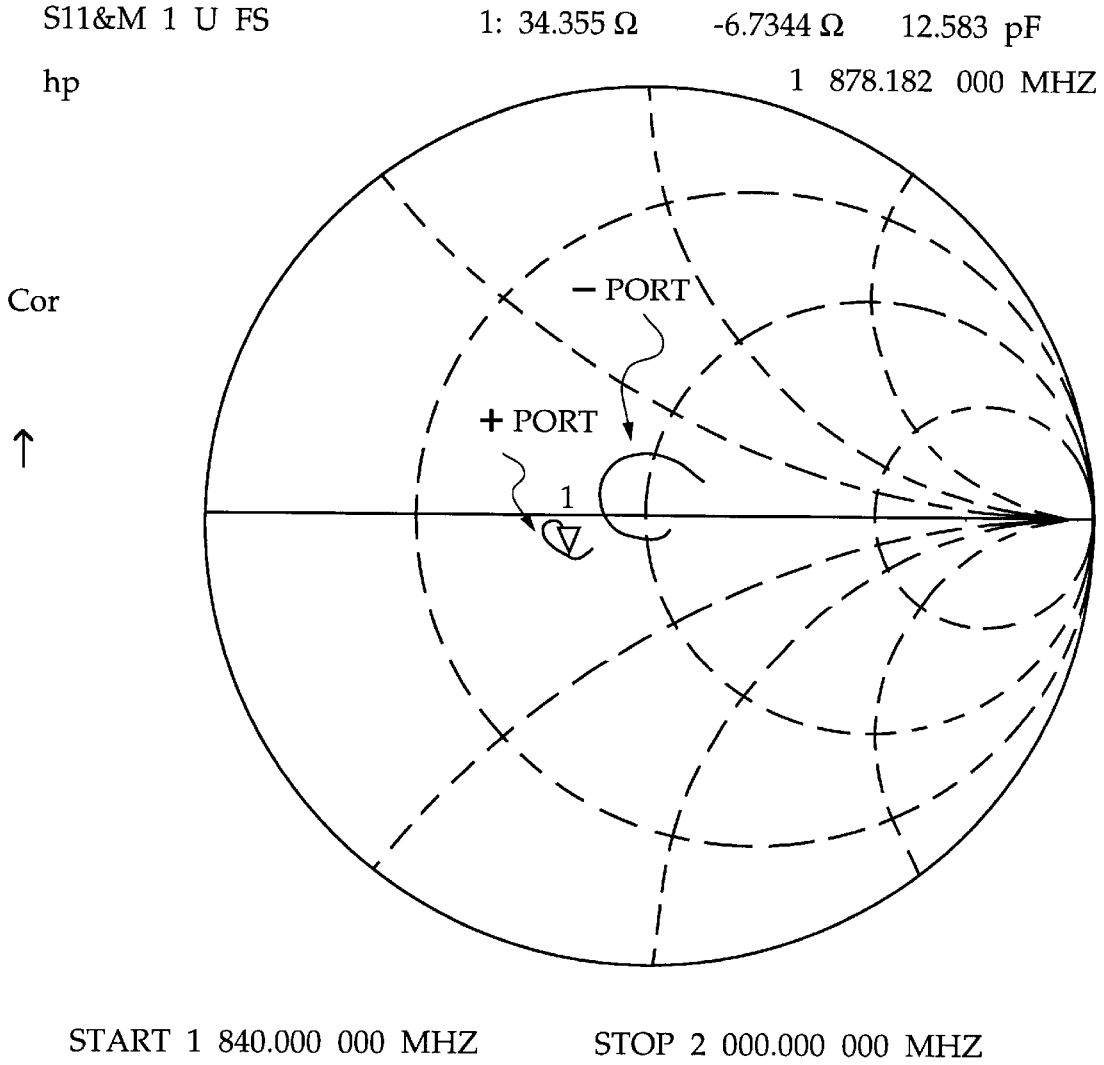
FIG. 12 is a graph of the input match of narrow spaced bow tie dipoles for a feed rod having a diameter of 0.050.

FIG. 8A shows a dual chamber, one for each polarization, generally indicated as 110, 112, each having a feedline generally indicated as 114, 116 for a respective polarization. FIG. 8B shows top and bottom feedlines generally indicated as 118 mounted on the feedlines 114, 116 for coupling to the feed rods 34, 54, in a manner that would be appreciated by a person skilled in the art.

IMPROVED RF ISOLATION DEVICES

The present invention also provides various improved RF isolation devices for the antennas with a plurality of bow tie assemblies 24 (FIG. 1) so as to increase isolation between inputs of opposite polarization. The improvements all feature different ways for coupling RF energy back to the dipoles forming the bow tie assemblies, the RF energy coupled having a phase and magnitude so as to cancel undesired RF energy coupled between dipoles of opposite polarization. The improved RF isolation device may include (1) one or more isolation trees or bars arranged between bow tie assemblies; (2) one or more isolation rails arranged alongside bow tie assemblies; (3) one or more small and thin isolation rods or wires arranged in or on a radome that covers bow tie assemblies; (4) one or more isolation strips arranged between a positive and negative arm of a dipole of a bow tie assembly; or (5) a combination of one or more of the above. Each will be separately described in more detail below, although it should be understood that the different ways can be used alone or in combination with one another to obtain increased isolation between the antenna inputs of opposite polarity.

RF Isolation Device No. 1

FIGS. 13–17 show an antenna generally indicated as 150 having a ground reflector plate 152 and twelve bow tie assemblies 154, 156, 158, 160, 162, 164, 166, 168, 170, 172, 174, 176 mounted thereon, which are each similar to that shown in FIGS. 1–4. The antenna 150 shown in FIGS. 13–17 features an improved isolation device that includes an isolation tree 180.

Figure 13:
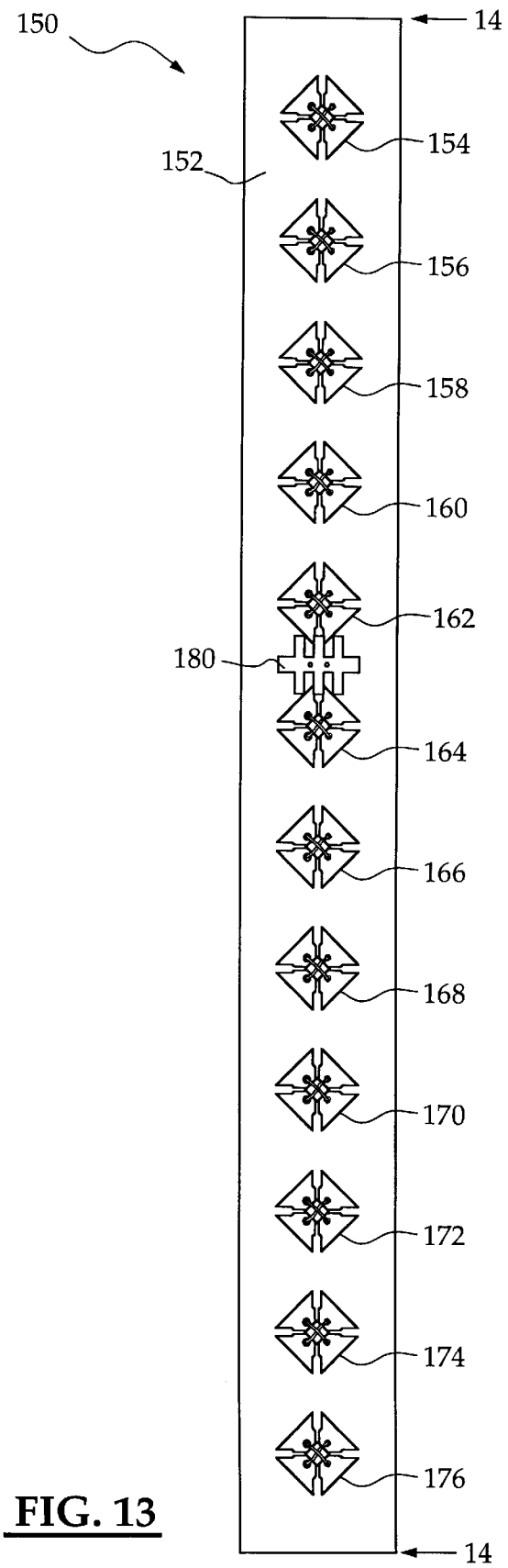
FIG. 13 is a diagram of an elevational view of an embodiment of an antenna having an RF isolation device.
Figure 14:
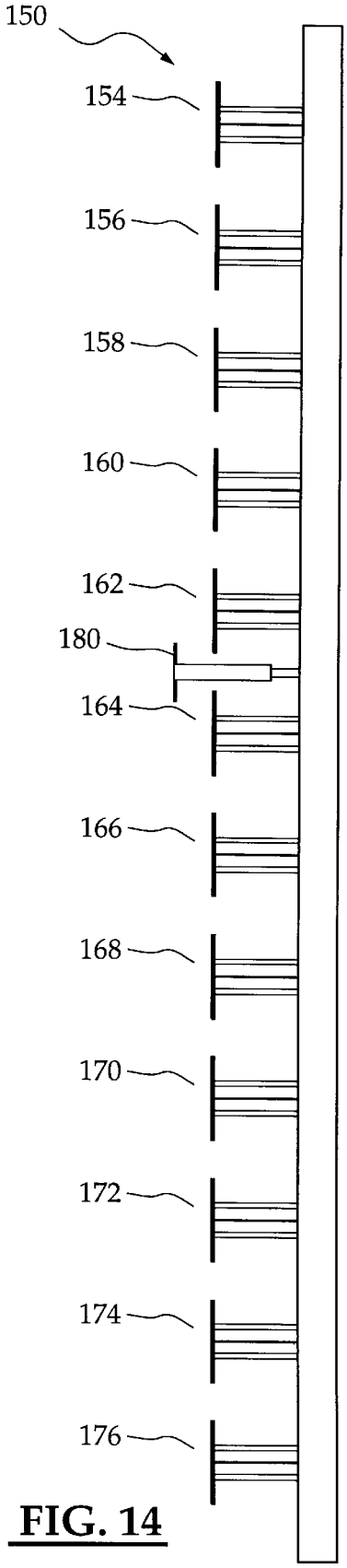
FIG. 14 is a side view of the antenna shown in FIG. 13 along lines 14—14.
Figure 18:
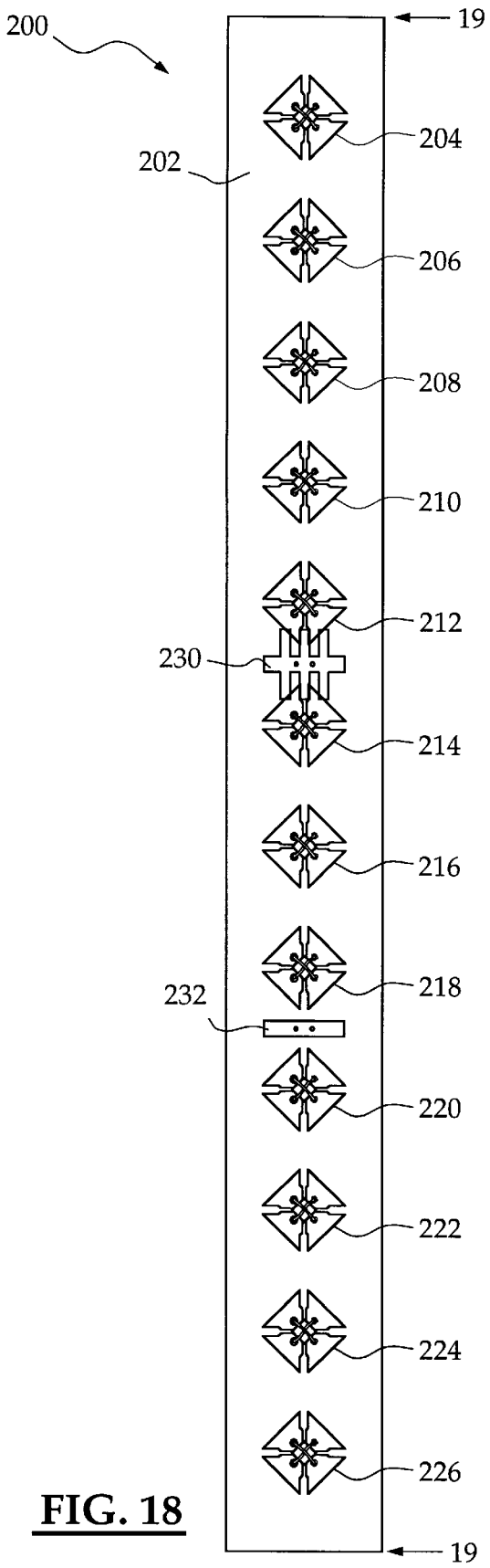
FIG. 18 is a diagram of an elevational view of an embodiment of an antenna also having an RF isolation device.
Figure 19:
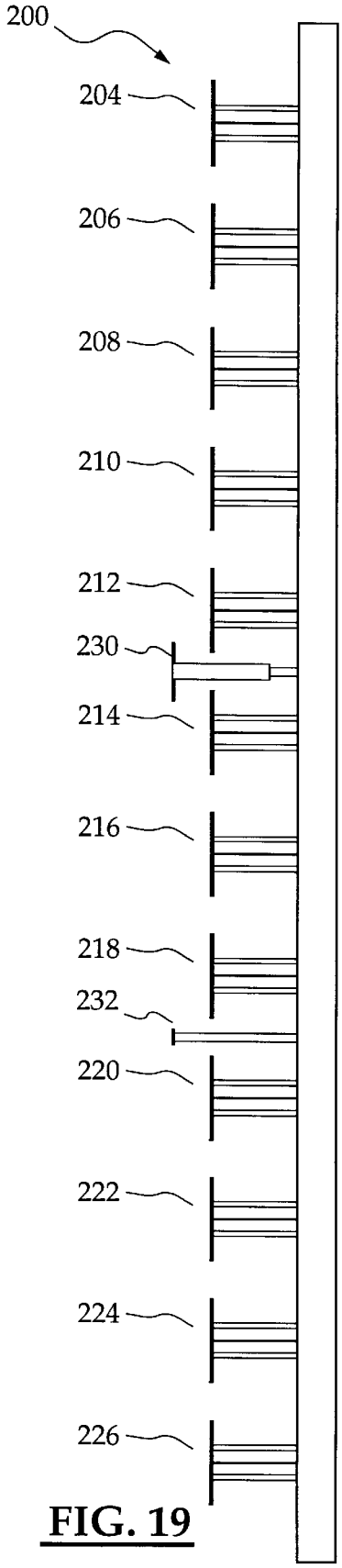
FIG. 19 is a side view of the antenna shown in FIG. 18 along lines 19—19.

As shown in FIGS. 13 and 14, the twelve bow tie assemblies 154, 156, 158, 160, 162, 164, 166, 168, 170, 172, 174, 176 are arranged in a linear array. As shown, the isolation tree 180 is positioned between the cross bow tie dipoles 162, 164.

As shown in FIG. 15, the isolation tree 180 has a top surface 182 having eight branches 184, 186, 188, 190, 192, 194, 196 and 198. Six side branches 186, 188, 190, 194, 196 and 198 each have a width w1 of about 0.390 inches, a height of about 0.835 inches and are separate by a distance d of about 0.545 inches. Two end branches 184 and 192 have a width w2 of about 0.600 inches.

As shown in FIGS. 16 and 17, the isolation tree 180 has legs 199*a*, 199*b*, has a length of about 3.780 inches, has a height H of about 2.550 inches, and has a width W of about 2.270 inches. The legs 199*a*, 199*b* are connected to two insulation standoffs shown in FIGS. 22–23 and discussed in more detail below, and mounted and insulated from the ground reflector plate 152.

Generally, the scope of the invention is not intended to be limited to any particular size, shape or location for the isolation tree. Embodiments are envisioned where one or more isolation tree 130 are positioned in relation to one or more of the twelve bow tie assemblies 154, 156, 158, 160, 162, 164, 166, 168, 170, 172, 174, 176 including positioning a respective isolation tree next to or over a particular bow tie assembly. A person skilled in the art would appreciate that the size, shape and location of the isolation tree, as well as the combination thereof, can vary from antenna to antenna and still be with the spirit of the invention.

RF Isolation Device No. 2

FIGS. 18–23 show a second embodiment of a dual polarization antenna generally indicated as 200 having a ground reflector plate 202 and twelve bow tie assemblies 204, 206, 208, 210, 212, 214, 216, 218, 220, 222, 224, 226 mounted thereon, which are each similar to that shown in FIGS. 1–4.

The antenna 200 shown in FIGS. 18–23 features an improved isolation device that includes an isolation tree 230 and an isolation bar 232. The isolation tree 230 is mounted between the bow tie assemblies 221, 214 and is similar to that shown in FIGS. 15–17. The isolation bar 232 is mounted between the bow tie assemblies 218, 220 and is shown in more detail in FIGS. 20–23. As shown in FIGS. 20–21, the isolation bar 232 includes a bar 234 having two standoff mounting apertures 236, 238 shown in FIGS. 22–23, and has a width $W_B$ of 0.600 inches and a length of $L_B$ of 3.170 inches. The isolation bar 240 is mounted on two insulation standoffs, one of which 240 is shown in FIGS. 22–23. As shown, the insulation standoff 240 has a mounting aperture for receiving a mounting screw (not shown), has a length $L_S$ of about 3.250 inches and a diameter of about 0.375 inches.

Generally, the scope of the invention is not intended to be limited to any particular size, shape or location for the isolation bar. A person skilled in the art would appreciate that the size, shape and location of the isolation bar, as well as the combination thereof, can vary from antenna to antenna and still be within the spirit of the invention.

RF Isolation Device No. 3

Figure 24:
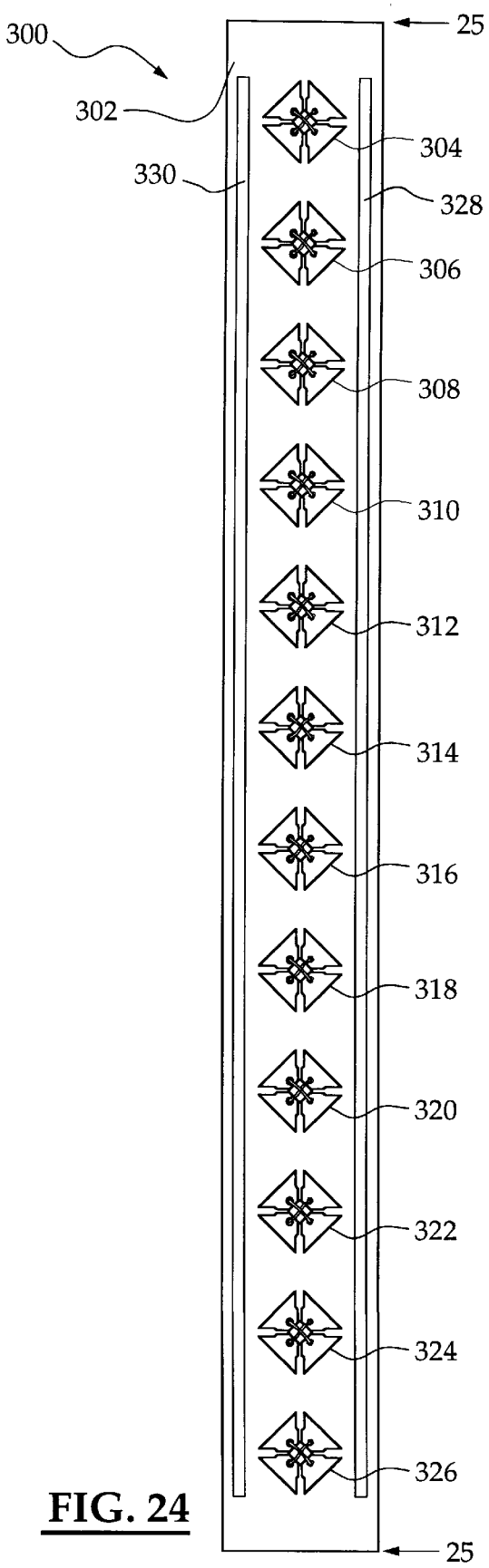
FIG. 24 is a diagram of an elevational view of an embodiment of an antenna also having an RF isolation device.
Figure 25:
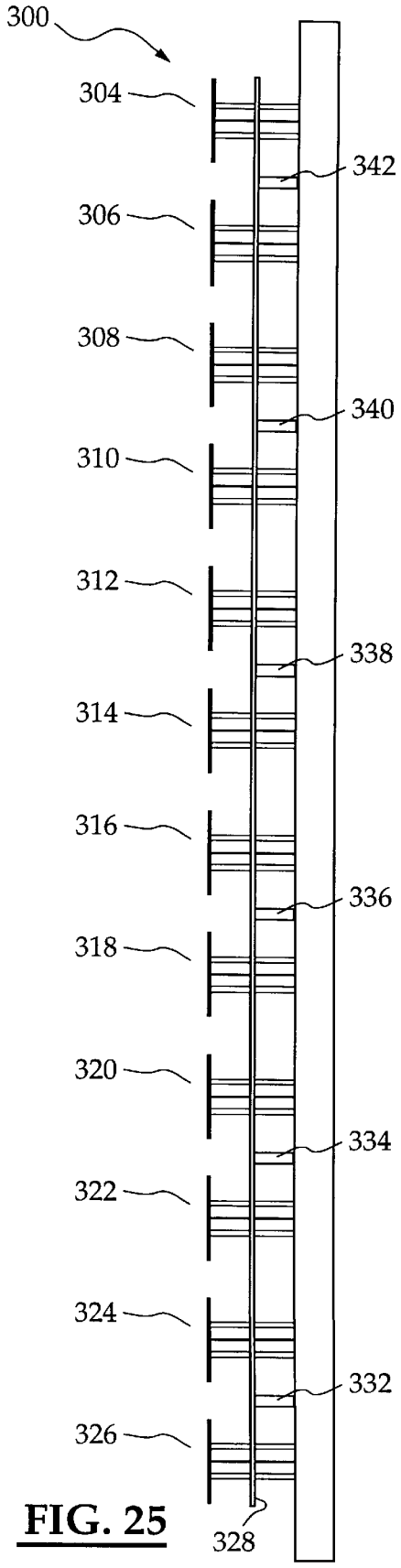
FIG. 25 is a side view of the antenna shown in FIG. 13 along lines 25—25.

FIGS. 24–25 show a third embodiment of a dual polarization antenna generally indicated as 300 having a ground reflector plate 302 and twelve bow tie assemblies 304, 306, 308, 310, 312, 314, 316, 318, 320, 322, 324, 326 mounted thereon, which are each similar to that shown in FIGS. 1–4.

The antenna 300 features an improved isolation device that includes two isolation rails 328, 330 that are arranged alongside the twelve bow tie assemblies 304, 306, 308, 310, 312, 314, 316, 318, 320, 322, 324, 326. As shown, the isolation rail 328 is mounted to the ground reflector plate 302 on six insulation standoffs 332, 334, 336, 338, 340, 342, each similar to that shown in FIGS. 22–23 and described above.

In one embodiment, the isolation rails 328, 330 extend the full length of the antenna 300, have a length in a range of 60–65 inches, and preferably about 60 inches, have a width in a range of ¼–¾ inches, and preferably about ⅜ inches, have a thickness of about 1/16 inches, have a height H from the ground reflector plate 402 in a range of ½–1¾ inches, and preferably about 1½ inches, and have a centering distance C from the center of the dipole array to the center of the rail in a range of 1–2 inches, and preferably about 1½ inches.

Generally, the scope of the invention is not intended to be limited to any particular size, shape or location for the isolation rail. A person skilled in the art would appreciate that the size, shape and location of the isolation rail, as well as the combination thereof, can vary from antenna to antenna and still be with the spirit of the invention.

RF Isolation Device No. 4

Figure 26:
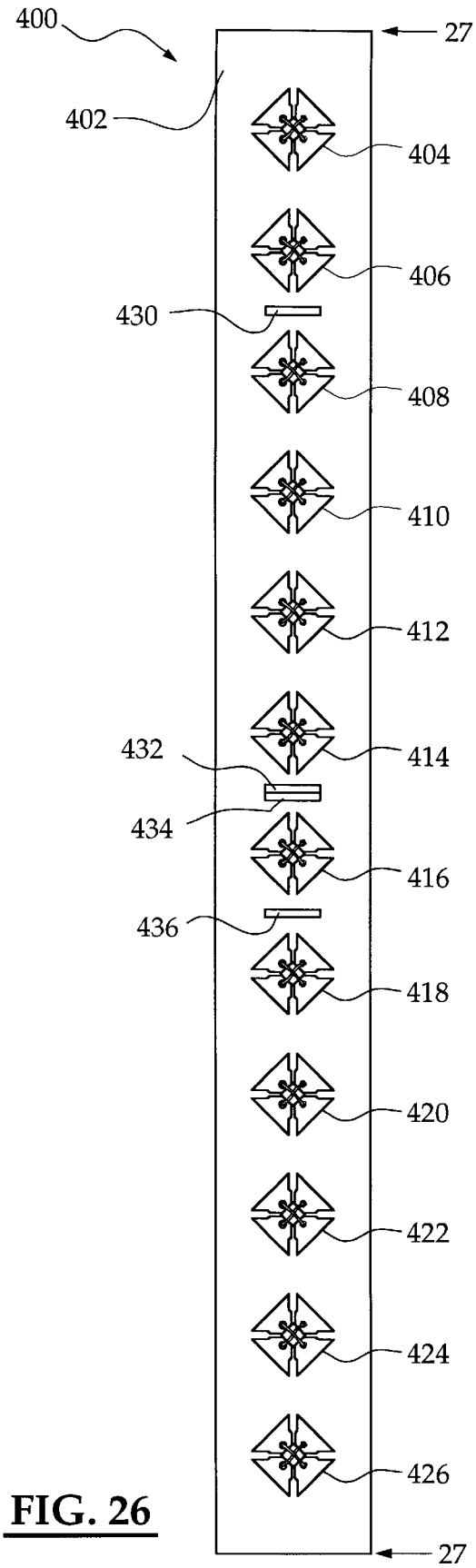
FIG. 26 is a diagram of an elevational view of an embodiment of an antenna also having an RF isolation device.
Figure 27:
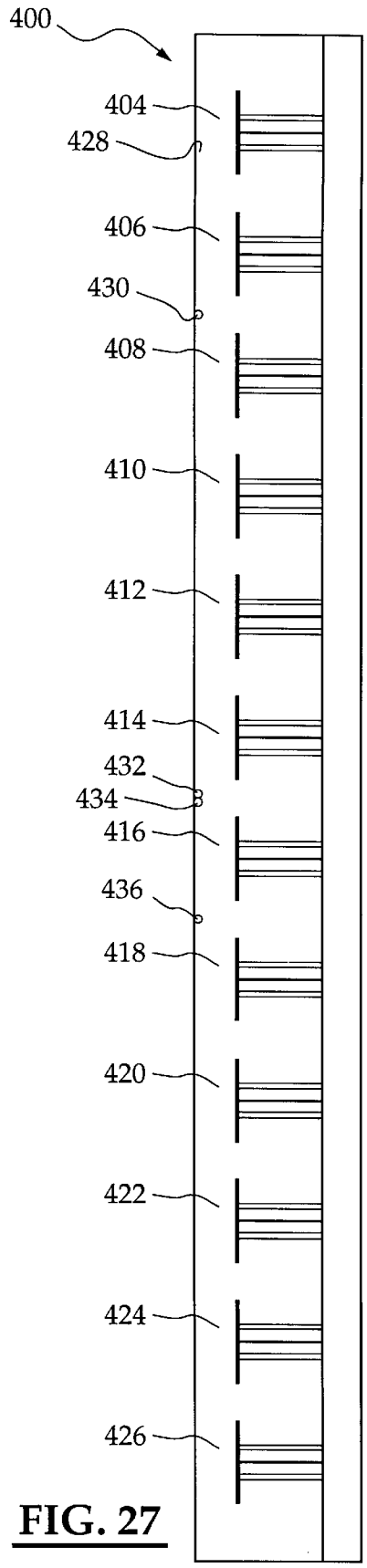
FIG. 27 is a side view of the antenna shown in FIG. 26 along lines 27—27.

FIGS. 26–27 show a fourth embodiment of a dual polarization antenna generally indicated as 400 having a ground reflector plate 402 and twelve bow tie assemblies 404, 406, 408, 410, 412, 414, 416, 418, 420, 422, 424, 426 mounted thereon, which are each similar to that shown in FIGS. 1–4. As shown, the antenna is covered by a radome generally indicated as 428.

The antenna 400 features an improved isolation device that includes small or thin isolation rods or wires 430, 432, 434, 436 that are either glued on or embedded within the radome 428. As shown, the small or thin isolation rod or wire 430 is arranged above and between bow tie assemblies 406, 408 and has a length in a range of about 55–75 millimeters, preferably of about 57.5 millimeters; the small or thin isolation rods or wires 432, 434 are arranged above and between bow tie assemblies 414, 416 and have respective lengths of about 62.5 and 57.4 millimeters; and the small or thin isolation rod or wire 436 is arranged above and between bow tie assemblies 416, 418 and has a length of about 66.5 millimeters. As shown, the small or thin isolation rods or wires 430, 432, 434, 436 may be arranged about 2.5 to 4.00 inches above the ground reflector plate 402. In operation, the small or thin isolation rods or wires 430, 432, 434, 436 are a short parasitic dipole, which actually re-radiates power which is coupled to it. Since they are arranged at an angle of 45 degrees to both bow tie dipoles, the energy is coupled back. The length of the small or thin isolation rods or wires 430, 432, 434, 436 is important for regulating the magnitude of the return signal, and the height of the rod or wire above the plane of the dipoles is important for regulating the phase of the return signal.

Figure 28:
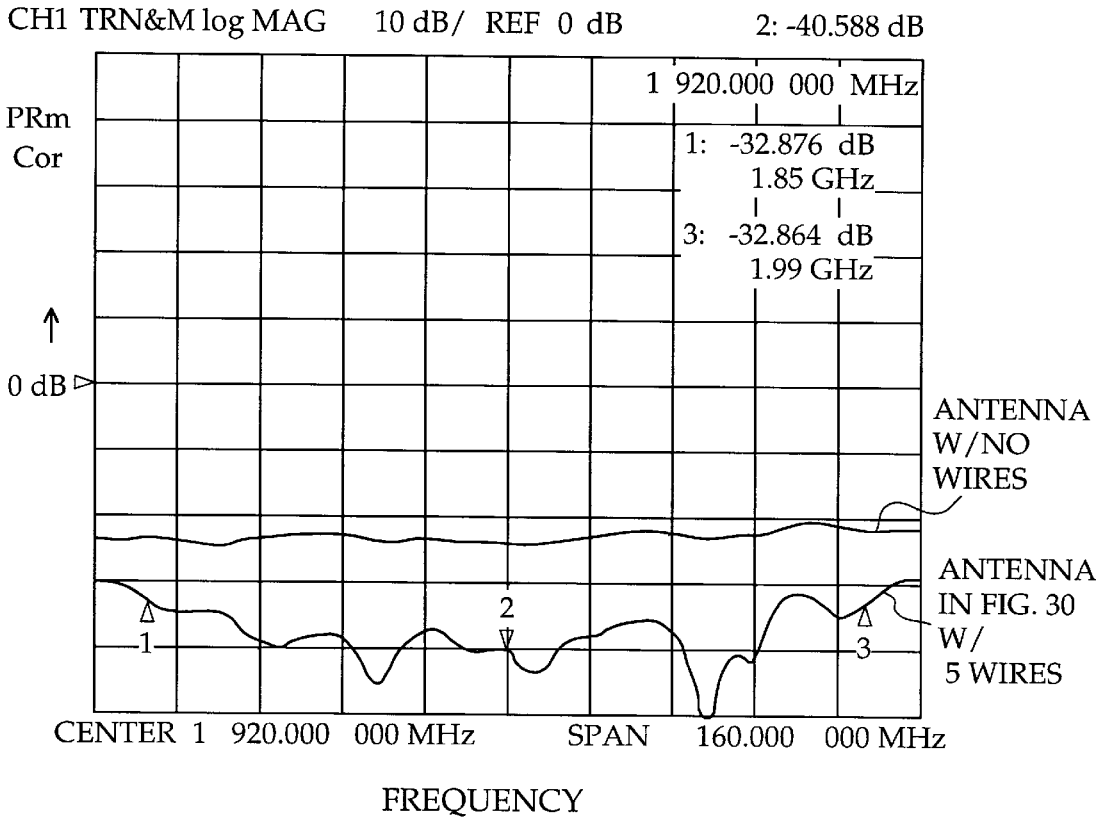
FIG. 28 is a graph of frequency versus decibels for the antenna shown in FIGS. 26–27.

FIG. 28 is a graph of frequency versus decibels showing a plot of the antenna 400 with and without the small or thin isolation rods or wires 430, 432, 434, 436.

Generally, the scope of the invention is not intended to be limited to any particular size, shape or location for the isolation rod or wire. A person skilled in the art would appreciate that the size, shape and location of the isolation rod or wire, as well as the combination thereof, can vary from antenna to antenna and still be within the spirit of the invention.

RF Isolation Device No. 5

Figure 30:
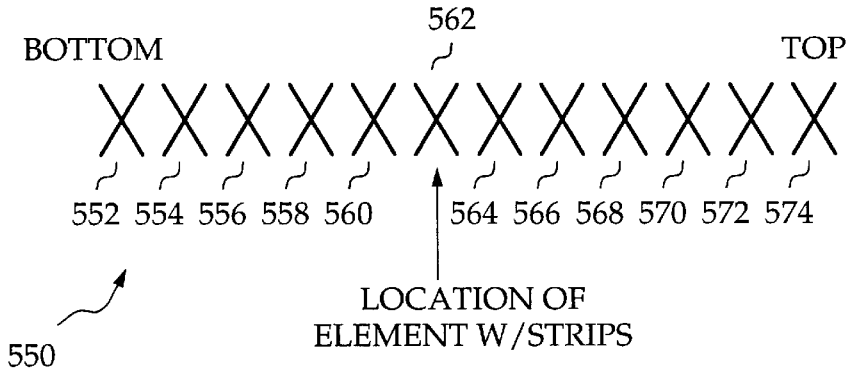
FIG. 30 is a diagram of an antenna substantially similar to that shown in FIGS. 13–14, 18–19, 24–25 and 26–27.

FIGS. 29–30 show an embodiment of a dual polarization antenna having a bow tie assembly 500 similar to that shown in FIGS. 1–4, having radiating arms 502, 504, 506, 508.

The bow tie assembly 500 features an isolation strip generally indicated as 510, 520, each having a thin strip of metal generally indicated as 512 and 522, which is placed on top of Delrin, Teflon or other insulating material generally indicated as 514, 524. The isolation strips 510, 520 have screw apertures 516, 518, 526, 528 for receiving screws (not shown) for coupling the thin strip 512, 522, the insulating material 514, 524, and the arm 502, 504, 506, 508.

Isolation in an array (inter-element) of dual polarized bow ties may be as low as 22 dB, even though a single bow tie (intra-element) may have greater than 30 dB isolation. This is because of RF energy that couples to the neighboring bow tie in the opposite polarization. The whole idea of the present invention is to couple energy back in the proper phase and magnitude, so as to cause a cancellation of undesired RF energy from coming back out the port of the opposite polarization.

The thickness of 510, 520 will have an effect of regulating the coupling of RF energy from one pair to the other pair of bow tie dipoles, typically (but not limited to) 0.050 inches thick.

The length and width has an equal effect of regulating coupling of RF energy to the other polarization. The reason for this is that adjacent dipole arms are actually members of the opposite polarization radiating dipole (which consists of two dipole arms). Depending on the phase and magnitude of individual array elements, these isolation strips may or may not be needed on individual array elements.

Figure 31:
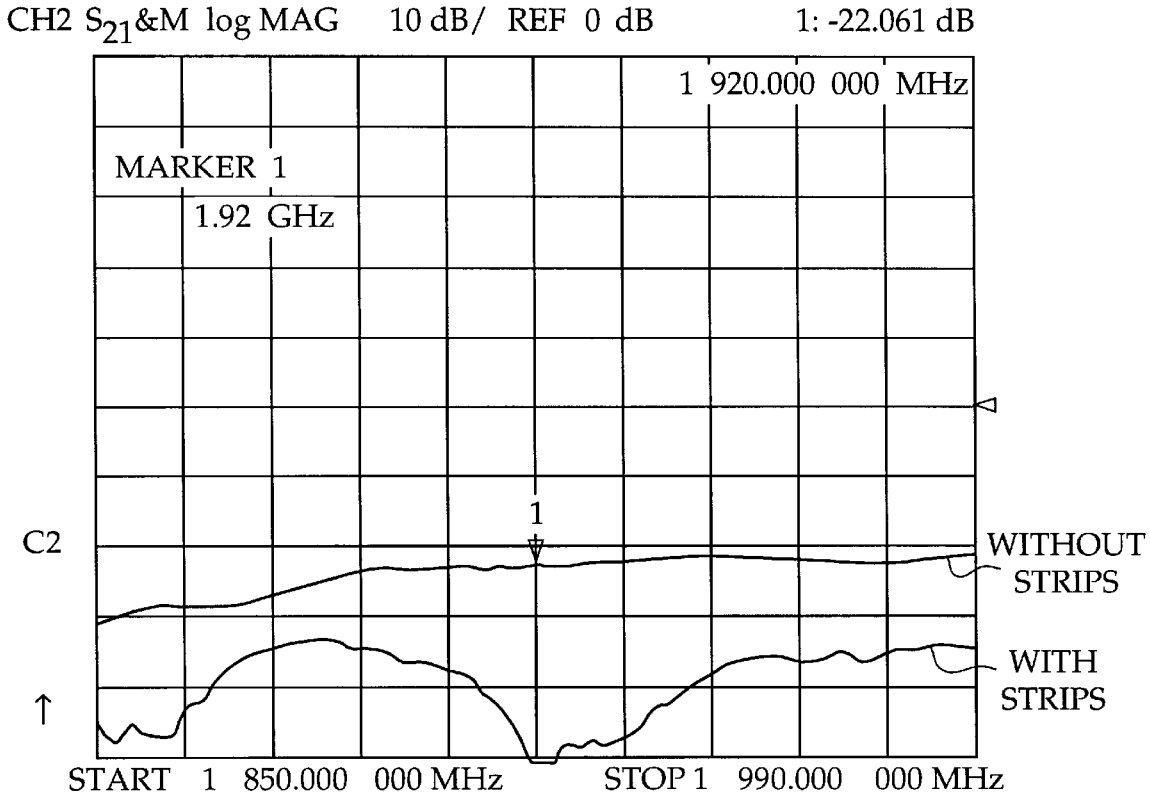
FIG. 31 is a graph of frequency versus decibels for the antenna shown in FIG. 30.

FIG. 30 shows a diagram of an antenna generally indicated as 550 having twelve bow tie assemblies 552, 554, 556, 558, 560, 562, 564, 566, 568, 570, 572, 574 similar to that shown in FIGS. 1–4, having the bow tie assembly 500 with the isolation strips 510, 520 shown in FIG. 29 arranged as bow tie assembly 562. FIG. 31 is a graph of frequency versus decibels showing a plot of an antenna with and without the bow tie assembly 562.

Generally, the scope of the invention is not intended to be limited to any particular size, shape or location for the isolation strips. A person skilled in the art would appreciate that the size, shape and location of the isolation strip, as well as the combination thereof, can vary from antenna to antenna and still be within the spirit of the invention.

SCOPE OF THE INVENTION

Although the present invention has been described and discussed herein with respect to two embodiments, other arrangements or configurations may also be used that do not depart from the spirit and scope of the invention.

For example, the scope of the invention is not intended to be limited to any particular capacitance, inductance or resistance, shape or dimension of the various components shown in the drawing. Moreover, the scope of the invention is not intended to be limited to an antenna having two dipoles. Embodiments are envisioned for an antenna for transmitting or receiving radio signals, including a reflector plate for reflecting the radio signals; bow tie dipoles for transmitting or receiving the radio signals; and U-shaped air-filled transmission feedlines for transmitting radio signals between the reflector plate means and the bow tie dipoles.

Similar to that above, in such an antenna the U-shaped air-filled transmission feedlines may include two pairs of U-shaped air-filled transmission feedlines, each pair having a rod arranged therein, and each U-shaped air-filled transmission feedline may have a rectangular shape with at least three sides for isolating undesirable radio frequency energy.

I claim:

1. A dual polarization antenna (20, 80, 150, 200, 300, 400, 500) for transmitting or receiving polarized radio frequency signals, comprising:

a reflector plate (22, 152, 202, 302, 402) that is a ground plane and that reflects the polarized radio frequency signals;

one or more bow tie assemblies (24; 82, 84, 86, 88, 90, 92, 94, 96, 98, 100, 102, 104; 154, 156, 158, 160, 162, 164, 166, 168, 170, 172, 174, 176; 204, 206, 208, 210, 212, 214, 216, 218, 220, 222, 224, 226; 304, 306, 308, 310, 312, 314, 316, 318, 320, 322, 324, 326; 404, 406, 408, 410, 412, 414, 416, 418, 420, 422, 424, 426; 500), each having two cross bow tie dipoles (26, 28) with radiating arms (40, 42; 60, 62) for transmitting or receiving the polarized radio frequency signals at two polarizations, each cross bow tie dipoles (26, 28) also having U-shaped air-filled transmission feedline means (30, 32, 34; 50, 52, 54) for supporting respective radiating arms (40, 42; 60, 62) and for providing the polarized radio frequency signals between the reflector plate (22, 152, 202, 302, 402) and said respective radiating arms (40, 42; 60, 62).

2. A dual polarization antenna (20, 80, 150, 200, 300, 400, 500) according to claim 1, wherein each U-shaped air-filled transmission feedline means (30, 32, 34; 50, 52, 54) includes two legs (30, 32; 50, 52) and a respective feed rod (34; 54) arranged in a respective one of the two legs (30, 32; 50, 52).

3. A dual polarization antenna (20, 80, 150, 200, 300, 400, 500) according to claim 2, wherein each leg (30, 32; 50, 52) has a rectangular shape with at least three sides (66, 68, 70) for isolating undesirable radio frequency energy.

4. A dual polarization antenna (20, 80, 150, 200, 300, 400, 500) according to claim 2, wherein the characteristic impedance of each U-shaped rectangular air-filled transmission feedline means (30, 32, 34; 50, 52, 54) is substantially the same as the impedance of a respective cross bow tie dipole (26, 28), and is calculated by the following equation:

$$Z_0 = \frac{138}{\sqrt{\varepsilon_r}} \operatorname{Log}_{10}\left[\frac{4D}{\pi d}\operatorname{Tanh}\frac{\pi h}{d}\right]$$

where D is a one-sided or open dimension of the respective U-shaped rectangular air-filled transmission feedline means (30, 32, 34; 50, 52, 54), d is a diameter of a respective feed rod (34; 54), and h is a distance from a respective single wall of the respective U-shaped rectangular air-filled transmission feedline means (30, 32, 34; 50, 52, 54) to a respective center of the respective feed rod (34; 54).

5. A dual polarization antenna (20, 80, 150, 200, 300, 400, 500) according to claim 1, wherein the respective radiating arms (40, 42; 60, 62) include triangularly-shaped arms (40, 42; 60, 62), each having notches (40*a*, 40*b*; 42*a*, 42*b*; 60*a*, 60*b*; 62*a*, 62*b*) dimensioned for minimizing radiation pattern distortion due to undesirable radio frequency coupling between the two cross bow tie dipoles (26, 28).

6. A dual polarization antenna (20, 80, 150, 200, 300, 400, 500) according to claim 5, wherein each triangularly-shaped arm has an inner corner (46*a*) with a 90 degree angle, two outer corners (46*b*, 46*c*) having respective 45 degree angles, and a respective side (46*d*, 46*e*) in relation to the inner corner (46*a*) and the two outer corners (46*b*, 46*c*), each outer corner (46*b*, 46*c*) having a respective symmetrical notch (40*a*, 40*b*; 42*a*, 42*b*; 60*a*, 60*b*; 62*a*, 62*b*) cut therein along the respective side (46*d*, 46*e*).

7. A dual polarization antenna according (20, 80, 150, 200, 300, 400, 500) to claim 6, wherein each respective symmetrical notch (40*a*, 40*b*; 42*a*, 42*b*; 60*a*, 60*b*; 62*a*, 62*b*) has an edge substantially 46*f*, 46*g*) parallel to the respective side (46*d*, 46*e*).

8. A dual polarization antenna (20, 80, 150, 200, 300, 400, 500) according to claim 7, wherein each respective side (46*d*, 46*e*) has a length (Ls) and each symmetrical notch (40*a*, 40*b*; 42*a*, 42*b*; 60*a*, 60*b*; 62*a*, 62*b*) has a corresponding length (Ln) that is substantially equal to the length (Ls) of the respective side (46*d*, 46*e*).

9. A dual polarization antenna (20, 80, 150, 200, 300, 400, 500) according to claim 8, wherein the corresponding length (Ln) of each symmetrical notch (40*a*, 40*b*; 42*a*, 42*b*; 60*a*, 60*b*; 62*a*, 62*b*) and the length (Ls) of the respective side (46*d*, 46*e*) are dimensioned with a ratio in a range of 1:3 to 3:1.

10. A dual polarization antenna (20, 80, 150, 200, 300, 400, 500) according to claim 1, wherein the radio signals include a first radio signal and a second radio signal that is independent of the first radio signal, for transmitting or receiving radio signals having orthogonal polarizations.

11. A dual polarization antenna (20, 80, 150, 200, 300, 400, 500) according to claim 1, wherein the radio signals include a first radio signal and a second radio signal having a 90 degree phase difference from the first radio signal, for transmitting or receiving circularly polarized radio signals having orthogonal polarizations.

12. A dual polarization antenna (20, 80, 150, 200, 300, 400, 500) according to claim 1, wherein the one or more bow tie assemblies (24; 82, 84, 86, 88, 90, 92, 94, 96, 98, 100, 102, 104; 154, 156, 158, 160, 162, 164, 166, 168, 170, 172, 174, 176; 204, 206, 208, 210, 212, 214, 216, 218, 220, 222, 224, 226; 304, 306, 308, 310, 312, 314, 316, 318, 320, 322, 324, 326; 404, 406, 408, 410, 412, 414, 416, 418, 420, 422, 424, 426; 500) further comprises a base (29) for mounting on the reflector plate (22, 152, 202, 302, 402).

13. A dual polarization antenna (20, 80, 150, 200, 300, 400, 500) according to claim 12, wherein the base (29) has a ¼λ dipole spacer shorting plate (72) connected to the U-shaped rectangular air-filled transmission feedline means (30, 32, 34; 50, 52, 54).

14. A dual polarization antenna (20, 80, 150, 200, 300, 400, 500) according to claim 1, wherein the dual polarization antenna further comprises an RF isolation device (180; 230, 232; 328, 330; 430, 432, 434, 436; 510, 520) for coupling RF energy back to the pairs of cross dipoles (26, 28) forming the bow tie assemblies (24; 82, 84, 86, 88, 90, 92, 94, 96, 98, 100, 102, 104; 154, 156, 158, 160, 162, 164, 166, 168, 170, 172, 174, 176; 204, 206, 208, 210, 212, 214, 216, 218, 220, 222, 224, 226; 304, 306, 308, 310, 312, 314, 316, 318, 320, 322, 324, 326; 404, 406, 408, 410, 412, 414, 416, 418, 420, 422, 424, 426; 500), the RF energy being coupled having a phase and magnitude so as to cancel undesired RF energy coupled between dipoles (26, 28) of opposite polarization.

15. A dual polarization antenna (20, 80, 150, 200, 300, 400, 500) according to claim 14, wherein the RF isolation device (180; 230, 232; 328, 330; 430, 432, 434, 436; 510, 520) includes either (1) one or more isolation trees (180, 230) or bars (232) arranged in relation to bow tie assemblies (154, 156, 158, 160, 162, 164, 166, 168, 170, 172, 174, 176; 204, 206, 208, 210, 212, 214, 216, 218, 220, 222, 224, 226); (2) one or more isolation rails (328, 330) arranged alongside the one or more bow tie assemblies (304, 306, 308, 310, 312, 314, 316, 318, 320, 322, 324, 326; 404, 406, 408, 410, 412, 414, 416, 418, 420, 422, 424, 426; 500); (3) one or more small thin isolation rods or wires (430, 432, 434, 436) arranged in or on a radome (428) that covers the one or more bow tie assemblies (402, 404, 406, 408, 410, 412, 414, 416, 418, 420, 422, 424, 426); (4) one or more isolation strips (510, 520) coupled between positive and negative arms (502, 506; 504, 508) of a bow tie assembly (500); or (5) a combination of one or more of the above.

16. A dual polarization antenna (20, 80, 150, 200, 300, 400, 500) according to claim 15, wherein the RF isolation device (180; 230, 232; 328, 330; 430, 432, 434, 436; 510, 520) includes an isolation tree (180; 230) having a top surface (182) with eight branches (184, 186, 188, 190, 192, 194, 196, 198) and having two legs (199*a*, 199*b*) connected to respective standoffs (199*a*, 199*b*) for supporting the same on the reflector plate (152).

17. A dual polarization antenna (20, 80, 150, 200, 300, 400, 500) according to claim 15, wherein the RF isolation device (180; 230, 232; 328, 330; 430, 432, 434, 436; 510, 520) includes an isolation bar (232) having a flat top surface (234) and having two mounting standoff apertures (236, 238) for receiving two insulation standoffs (240) for supporting the same on the reflector plate (22, 152, 202, 302, 402).

18. A dual polarization antenna (20, 80, 150, 200, 300, 400, 500) according to claim 15, wherein the dual polarization antenna (20) has twelve bow tie assemblies (204, 206, 208, 210, 212, 214, 216, 218, 220, 222, 224, 226) arranged in a linear array, wherein the isolation bar (232) is positioned between a fourth and fifth bow tie assembly (218, 220), and wherein the isolation tree (230) is positioned between a seventh and eighth bow tie assembly (212, 214).

19. A dual polarization antenna (20, 80, 150, 200, 300, 400, 500) according to claim 15, wherein the RF isolation device (180; 230, 232; 328, 330; 430, 432, 434, 436; 510, 520) includes a side isolation rail (328, 330) mounted of the reflector plate (302).

20. A dual polarization antenna (20, 80, 150, 200, 300, 400, 500) according to claim 15, wherein the RF isolation device (180; 230, 232; 328, 330; 430, 432, 434, 436; 510, 520) includes one or more small thin isolation rods or wires (430, 432, 434, 436) embedded in or arranged on a radome (428) that covers the dual polarization antenna (400).

21. A dual polarization antenna (20, 80, 150, 200, 300, 400, 500) according to claim 15, wherein the one or more small and thin isolation rods or wires (430, 432, 434, 436) are positioned at an angle of about 45 degrees between the one or more bow tie assemblies (404, 406, 408, 410, 412, 414, 416, 418, 420, 422, 424, 426).

22. A dual polarization antenna (20, 80, 150, 200, 300, 400, 500) according to claim 15, wherein the one or more small and thin isolation rods or wires (430, 432, 434, 436) have a length in a range of about 55–75 millimeters that determines the magnitude of a return signal that cancels the undesirable RF energy of the respective opposite polarization.

23. A dual polarization antenna (20, 80, 150, 200, 300, 400, 500) according to claim 22, wherein the one or more small and thin isolation rods or wires (430, 432, 434, 436) have a height in a range of about 2.5 to 4.0 inches above the ground plate that determines a phase of a return signal that cancels the undesirable RF energy of the respective opposite polarization.

24. A dual polarization antenna (20, 80, 150, 200, 300, 400, 500) according to claim 15, wherein the RF isolation device (180; 230, 232; 328, 330; 430, 432, 434, 436; 510, 520) includes means for coupling undesired RF energy having one or more isolation strips (510, 520), each having:

an insulator (514, 524) connected between a first dipole arm (502, 508) and a second dipole arm (504, 506); and a thin strip of metal (512, 522) arranged on the insulator (514, 524) for coupling the first dipole arm (502, 508) and the second arm (504, 506).

25. A dual polarization antenna for transmitting or receiving polarized radio frequency signals, comprising:

a reflector plate that is a ground plane and that reflects the polarized radio frequency signals;

at least one cross dipole assembly, each having two cross dipoles with radiating arms for transmitting or receiving the polarized radio frequency signals at two polarizations, each cross dipole also having U-shape air-filled transmission feedline means for supporting respective radiating arms and for providing the polarized radio frequency signals between the reflector plate and said respective radiating arms; and an RF isolation device for coupling RF energy back to the pairs of cross dipoles forming the cross dipole assemblies, the RF energy being coupled having a phase and magnitude so as to cancel undesired RF energy coupled between dipoles of opposite polarization.

26. A dual polarization antenna according to claim 25, wherein the RF isolation device includes either (1) one or more isolation trees or bars arranged in relation to cross dipole assemblies; (2) one or more isolation rails arranged alongside the one or more cross dipole assemblies; (3) one or more small thin isolation rods, wires or strips arranged in or on a radome that covers the one or more cross dipole assemblies; or (4) a combination thereof.

27. A dual polarization antenna according to claim 25, wherein the RF isolation device includes an isolation tree having a top surface with branches and having two legs connected to respective standoffs for supporting the same on the reflector plate.

28. A dual polarization antenna according to claim 25, wherein the RF isolation device includes an isolation bar having a flat top surface and having at least one mounting standoff apertures for receiving two insulation standoffs for supporting the same on the reflector plate.

29. A dual polarization antenna according to claim 25, wherein the dual polarization antenna has a multiplicity of cross dipole assemblies arranged in a linear array; and wherein the RF isolation device includes an isolation bar positioned between two cross dipole assemblies, and an isolation tree positioned between another cross dipole assemblies.

30. A dual polarization antenna according to claim 25, wherein the RF isolation device includes a side isolation rail mounted on the reflector plate.

31. A dual polarization antenna according to claim 25, wherein the RF isolation device includes one or more small thin isolation rods, wires or strips embedded in or arranged on a radome that covers the dual polarization antenna.

32. A dual polarization antenna according to claim 31, wherein the one or more small and thin isolation rods or wires are positioned at an angle of about 45 degrees between the one or more cross dipole assemblies.

33. A dual polarization antenna according to claim 31, wherein the one or more small and thin isolation rods or wires have a length in a range of about 55–75 millimeters that determines the magnitude of a return signal that cancels the undesirable RF energy of the respective opposite polarization.

* * * * *

UNITED STATES PATENT AND TRADEMARK OFFICE

CERTIFICATE OF CORRECTION

PATENT NO : 6,028,563

DATED : February 22, 2000

INVENTOR(S) : Higgins

It is certified that error appears in the above-identified patent and that said Letters Patent are hereby corrected as shown below:

On the Title Page

Section [56]:

Under References Cited, U.S. Patent Documents, Theobald et al., please delete "4,575,725" and insert --4,575,728--.

At column 15 (claim 25), line 54, please delete "U-shape" and insert --U-shaped--.

At column 13 (claim 7), lines 10-11, please delete "A dual polarization antenna according (20, 80, 150, 200, 300, 400, 500) to" and insert --A dual polarization antenna (20, 80, 150, 200, 300, 400, 500) according to--.

At column 13 (claim 7), line 42, please delete "has an edge substantially 46f, 46g)" and insert --has an edge (46f, 46g) substantially--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*